US009404445B2

(12) United States Patent
Furuhata et al.

(10) Patent No.: US 9,404,445 B2
(45) Date of Patent: Aug. 2, 2016

(54) EVAPORATED FUEL TREATMENT APPARATUS

(71) Applicant: HONDA MOTOR CO., LTD., Minato-Ku, Tokyo (JP)

(72) Inventors: Taisuke Furuhata, Wako (JP); Mahito Shikama, Wako (JP); Ayumu Horiba, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 193 days.

(21) Appl. No.: 14/282,286

(22) Filed: May 20, 2014

(65) Prior Publication Data

US 2014/0345576 A1 Nov. 27, 2014

(30) Foreign Application Priority Data

May 22, 2013 (JP) ..... 2013-107757
May 22, 2013 (JP) ..... 2013-107758

(51) Int. Cl.
*F02M 33/02* (2006.01)
*F02M 25/08* (2006.01)
*F02D 29/02* (2006.01)

(52) U.S. Cl.
CPC ..... *F02M 25/0809* (2013.01); *F02D 29/02* (2013.01)

(58) Field of Classification Search
CPC ..... F02M 25/0809; F02M 25/0836
USPC ..... 123/516, 518, 519, 520, 198 D; 701/107, 112; 73/114.38, 114.39
See application file for complete search history.

(56) References Cited

U.S. PATENT DOCUMENTS 7,159,580 B2 1/2007 Shikama et al.
2014/0257668 A1* 9/2014 Jentz ..... F02M 25/0809 701/102
2015/0142293 A1* 5/2015 Dudar ..... G01M 15/05 701/101

FOREIGN PATENT DOCUMENTS

JP 2006-077595 A1 3/2006

* cited by examiner

*Primary Examiner* — Hai Huynh
(74) *Attorney, Agent, or Firm* — Carrier Blackman & Associates, P.C.; Joseph P. Carrier; Fulchand P. Shende

(57) ABSTRACT

An evaporated fuel treatment apparatus includes a diagnosis section for leak diagnosis of an evaporated fuel tightly-closed system. In first diagnosis stage in which an atmosphere on-off valve is in close state after an ignition switch is turned off, the diagnosis section performs first leak diagnosis, based on relationship between tank internal pressure detected by a tank internal pressure sensor and first threshold value; and in second diagnosis stage in which the atmosphere on-off valve is in close state after completion of first leak diagnosis, the diagnosis section performs second leak diagnosis, based on relationship between tank internal pressure detected by the tank internal pressure sensor and second threshold value. The atmosphere on-off valve is once opened after completion of first leak diagnosis. First threshold value is set with larger deviation from the atmospheric pressure compared with second threshold value used in second diagnosis stage.

8 Claims, 8 Drawing Sheets

EVAPORATED FUEL TREATMENT APPARATUS

CROSS REFERENCE TO RELATED APPLICATION

This application claims the foreign priority benefit under Title 35, United States Code, §119(a)-(d) of Japanese Patent Application No. 2013-107757, filed on May 22, 2013 in the Japan Patent Office and Japanese Patent Application No. 2013-107758, filed on May 22, 2013 in the Japan Patent Office, the disclosures of which are herein incorporated by reference in their entirety.

BACKGROUND OF THE INVENTION

1. Field of the Invention

The present invention relates to an evaporated fuel treatment apparatus for treating evaporated fuel.

2. Description of the Related Art

For example, on a vehicle provided with an internal combustion engine, when a fuel tank is filled with liquid fuel, the occupied volume of the liquid fuel reserved in the inner space of the fuel tank increases. As a result, the occupied volume of the gas phase region in the inner space relatively decreases so that the pressure of the gas phase region (hereinafter, referred to as 'tank internal pressure') becomes higher than the atmospheric pressure. Consequently, the evaporated fuel of the gas phase region remaining in the fuel tank urges to get out into the atmosphere. If the evaporated fuel is released out into the atmosphere, the atmosphere (global environment) comes to be contaminated.

In this situation, in order to prevent contamination of the atmosphere (global environment) caused by releasing evaporated fuel out into the atmosphere, a conventional evaporated fuel treatment apparatus is provided with a canister having an absorbing member at a communication passage between a fuel tank and the atmosphere to temporarily absorb the evaporation material, and the evaporated fuel is thereby absorbed by the absorbing member of the canister so that the tank internal pressure is prevented from increasing.

For example, Patent Document 1 (Japanese Patent Application Laid-Open No. 2006-77595 (Paragraphs 0028-0030)) discloses an evaporated fuel treatment apparatus that includes a fuel tank, a canister, a charge communication passage for communication and connection between the fuel tank and the canister, an air communication passage for communication and connection between the canister and the atmosphere, a vent shut valve for opening and closing the air communication passage, a purge communication passage for communication and connection between the canister and an internal combustion engine, and a purge control valve for opening and closing the purge communication passage. The vent shut valve is open during fuel feeding or purge execution. The purge control valve is open during purge execution.

On the evaporated fuel treatment apparatus disclosed by Patent Document 1, after an internal combustion engine is stopped, selectively used are a first determination method based on a parameter corresponding to the secondary differential value of the internal pressure of the fuel tank and a second determination method based on a stagnation time of the internal pressure of the fuel tank, and performed is leak diagnosis of the evaporated fuel tightly-sealed system including the fuel tank. Concretely, if the generation amount of the evaporated fuel in the fuel tank is comparatively large, a diagnosis result by the first determination method is selected while, if the generation amount of the evaporated fuel is comparatively small, a diagnosis result by the second determination method is selected.

The evaporated fuel treatment apparatus according to Patent Document 1 enables accurate leak diagnosis of the evaporated fuel treatment apparatus with a comparatively simple configuration during when an internal combustion engine is stopped.

SUMMARY OF THE INVENTION

The principles of leak diagnoses related to the first and second determination methods used for the evaporated fuel treatment apparatus according to Patent Document 1 are both based on that, assuming that the ambient temperature related to the fuel tank fluctuates, the transition characteristic of the tank internal pressure is highly correlated with the existence or non-existence of a leak of the evaporated fuel tightly-closed system including the fuel tank, wherein the transition characteristic fluctuates in time-series in the process in which liquid fuel sealed in the inner space of the fuel tank evaporates (or liquefies), accompanying change in the ambient temperature related to the fuel tank.

Accordingly, in order to perform leak diagnosis with high accuracy in a short time on the evaporated fuel treatment apparatus related to Patent Document 1, it is desirable that the ambient temperature related to the fuel tank dynamically fluctuates from second to second.

However, for example, in a case that the evaporated fuel treatment apparatus according to Patent Document 1 is applied to a hybrid vehicle, on which an internal combustion engine and an electric motor are mounted as power sources and the internal combustion engine being the primary heat source operates only intermittently, if the internal combustion engine is operated with a low frequency, the fluctuation range of the ambient temperature related to the fuel tank becomes relatively smaller than an existing vehicle on which only an internal combustion engine is mounted as a power source. As a result, it has been difficult to perform leak diagnosis, with high accuracy, of an evaporated fuel tightly-closed system.

The present invention has been developed to solve the above-described problems, and an object of the invention is to provide an evaporated fuel treatment apparatus capable of performing with high accuracy leak diagnosis of an evaporated fuel tightly-closed system even when, for example, the invention is applied to a hybrid vehicle.

In order to achieve the above-described object, in aspect (1) of the present invention, an evaporated fuel treatment apparatus includes: a fuel tank for reserving fuel, the tank being mounted on a vehicle having an internal combustion engine; a canister provided between communication passages connecting the fuel tank and atmosphere to collect evaporated fuel exhausted from the fuel tank through the communication passage; an on-off valve provided at the communication passage connecting the canister and the atmosphere to open or close the canister to/from the atmosphere; a tank internal pressure detection section for detecting a tank internal pressure of the fuel tank; a control section for issuing an instruction to open or close the on-off valve; and a diagnosis section for performing leak diagnosis of an evaporated fuel tightly-closed system including the fuel tank.

After an ignition switch of the vehicle is turned off, in a first diagnosis stage in which the on-off valve is in a close state, according to the instruction from the control section, the diagnosis section performs a first leak diagnosis, based on a relationship between the tank internal pressure detected by the tank internal pressure detection section and a predetermined first threshold value; and after the first leak diagnosis is completed, in a second leak diagnosis stage in which the on-off valve is in the close state, according to the instruction from the control section, the diagnosis section performs a second leak diagnosis, based on a relationship between the tank internal pressure detected by the tank internal pressure detection section and a predetermined second threshold value. The on-off valve is once opened, according to the instruction from the control section, after the first leak diagnosis is completed. Then, the first threshold value used in the first diagnosis stage is set with a larger deviation from an atmospheric pressure compared with the second threshold value used in the second diagnosis stage.

In aspect (1) of the invention, in performing leak diagnosis after the ignition switch of the vehicle is turned off, dividing the leak diagnosis into two stages, the residual heat of the internal combustion engine and the exhaustion system of the internal combustion engine after the turning off of the ignition switch has more significant effect in the first diagnosis stage than in the second diagnosis stage, and accordingly the first threshold value used in the first diagnosis stage is set with a larger deviation from the atmospheric pressure compared with the second threshold value used in the second diagnosis stage.

In aspect (1) of the invention, the first and second threshold values are appropriately set, taking into account the respective widths of fluctuation of the tank internal pressures detected by the tank internal detection section in the first and second diagnosis stages. Accordingly, it is possible to perform with high accuracy a leak diagnosis of an evaporated fuel tightly-closed system even when, for example, the invention is applied to a hybrid vehicle.

In aspect (2) of the present invention, the evaporated fuel treatment apparatus in aspect (1) is arranged such that a first diagnosis period of the first diagnosis stage is within a stabilizing time period that is supposed to be required for stabilization of the tank internal pressure in comparison with a state immediately after the ignition switch is turned off, and the first diagnosis period is set to a time length shorter than a second diagnosis period of the second diagnosis stage.

In aspect (2) of the invention, in performing leak diagnosis after the ignition switch of the vehicle is turned off, dividing the leak diagnosis into two stages, the residual heat of the internal combustion engine and the exhaustion system of the internal combustion engine after the turning off of the ignition switch has more significant effect in the first diagnosis stage than in the second diagnosis stage, and accordingly the first diagnosis period is set to a shorter time length compared with the second diagnosis period.

According to aspect (2) of the invention, the lengths of the first and second diagnosis periods are appropriately set, taking into account the respective temporal variation rates of the tank internal pressures detected by the tank internal detection section in the first and second diagnosis stages. Accordingly, the accuracy of leak diagnosis of an evaporated fuel tightly-closed system can be further improved, compared with that in aspect (1).

In aspect (3) of the present invention, the evaporated fuel treatment apparatus in aspect (1) is arranged such that the on-off valve is once opened, according to the instruction from the control section, within a stabilizing time period that is supposed to be required for stabilization of the tank internal pressure in comparison with a state immediately after the ignition switch is turned off; and the diagnosis section starts the second diagnosis immediately after the on-off valve is turned from an open state to the close state, according to the instruction from the control section.

In aspect (4) of the present invention, the evaporated fuel treatment apparatus in aspect (2) is arranged such that the on-off valve is once opened, according to the instruction from the control section, within a stabilizing time period that is supposed to be required for stabilization of the tank internal pressure in comparison with a state immediately after the ignition switch is turned off; and the diagnosis section starts the second diagnosis immediately after the on-off valve is turned from an open state to the close state, according to the instruction from the control section.

According to aspect (3) or (4) of the invention, according to the instruction from the control section, the on-off valve is once opened within a stabilizing time period that is supposed to be required for stabilization of the tank internal pressure in comparison with a state immediately after the ignition switch is turned off, and the diagnosis section starts the second diagnosis, omitting a wasteful time, immediately after the on-off valve is turned from an open state to a close state, according to the instruction from the control section. Accordingly, it is possible to perform leak diagnosis of an evaporated fuel tightly-closed system in a shorter time and with a further higher accuracy compared with aspect (1) or (2).

Similarly to aspect (1) of the invention, in aspect (5) of the invention, an evaporated fuel treatment apparatus includes: a fuel tank for reserving fuel, the tank being mounted on a vehicle having an internal combustion engine; a canister provided between communication passages connecting the fuel tank and atmosphere to collect evaporated fuel exhausted from the fuel tank through the communication passage; an on-off valve provided at the communication passage connecting the canister and the atmosphere to open or close the canister to/from the atmosphere; a tank internal pressure detection section for detecting a tank internal pressure of the fuel tank; a control section for issuing an instruction to open or close the on-off valve; and a diagnosis section for performing leak diagnosis of an evaporated fuel tightly-closed system including the fuel tank.

In a state that the on-off valve is closed according to the instruction from the control section after an ignition switch of the vehicle is turned off, the diagnosis section: performs a leak diagnosis of the evaporated fuel tightly-closed system, using a double differentiation method based on a correlation parameter related to a secondary differentiation value of the tank internal pressure detected by the tank internal pressure detection section; performs a leak diagnosis of the evaporated fuel tightly-closed system, using a stagnation time method based on a relationship between a tank internal pressure detected by the tank internal pressure detection section and a stagnation time of the tank internal pressure; and uses a result of the leak diagnosis using the stagnation time method, giving priority over a result of the leak diagnosis using the double differentiation method.

The evaporated fuel treatment apparatus in aspect (5) of the invention uses a result of a leak diagnosis using the stagnation time method with a higher accuracy compared with the double differentiation method, giving priority over a result of a leak diagnosis using the double differentiation method. Concretely, for example, in a case that the result of the leak diagnosis using the stagnation time method is a normal state without leak, the diagnosis section determines a normal state without leak, regardless of the result of the leak diagnosis using the double differentiation method.

According to aspect (5) of the invention, a result of a leak diagnosis using a stagnation time method with a higher diagnosis accuracy compared with a double differentiation method is used, being given priority over a result of leak diagnosis using the double differentiation method. Accordingly, it is possible to perform a leak diagnosis of an evaporated fuel tightly-closed system even when the invention is applied, for example, to a hybrid vehicle.

In aspect (6) of the present invention, the evaporated fuel treatment apparatus in aspect (5) is arranged such that a diagnosis time for obtaining a result of a leak diagnosis using the stagnation time method is set to a time length longer than a diagnosis time for obtaining a result of a leak diagnosis using the double differentiation method.

According to aspect (6) of the invention, the diagnosis time for obtaining a result of a leak diagnosis using the stagnation time method is set to a time length longer than the diagnosis time for obtaining a result of a leak diagnosis using the double differentiation method. Accordingly, it is possible to perform a leak diagnosis of an evaporated fuel tightly-closed system with a further higher accuracy.

In aspect (7) of the present invention, the evaporated fuel treatment apparatus in aspect (5) is arranged such that, in a first diagnosis stage in which the on-off valve is in a close state according to the instruction from the control section after the ignition switch of the vehicle is turned off, the diagnosis section performs a first leak diagnosis based on a relationship between the tank internal pressure detected by the tank internal pressure detection section and a predetermined first threshold value; and in a second diagnosis stage in which the on-off valve is in the close state according to the instruction from the control section after completion of the first leak diagnosis, the diagnosis section performs a second leak diagnosis, using a pressure fluctuation detection method based on a relationship between the tank internal pressure detected by the tank internal pressure detection section and a predetermined second threshold value, the double differentiation method, and the stagnation time method.

After the first leak diagnosis is completed, the on-off valve is once opened according to the instruction from the control section, and if a result of the second leak diagnosis using the pressure fluctuation detection method is an abnormal state with leak, the diagnosis section determines an abnormal state with leak, regardless of a result of the second leak diagnosis using the double differentiation method or the stagnation time method.

According to aspect (7) of the invention, in a case that a result of the second leak diagnosis using the pressure fluctuation detection method is an abnormal state with leak, the diagnosis section determines an abnormal state with leak, regardless of a result of the second leak diagnosis using the double differentiation method or the stagnation time method. Accordingly, a leak diagnosis of an evaporated fuel tightly-closed system can be performed in a shorter time, compared with aspect (5) of the invention.

In aspect (8) of the present invention, the evaporated fuel treatment apparatus in aspect (6) is arranged such that, in a first diagnosis stage in which the on-off valve is in a close state according to the instruction from the control section after the ignition switch of the vehicle is turned off, the diagnosis section performs a first leak diagnosis based on a relationship between the tank internal pressure detected by the tank internal pressure detection section and a predetermined first threshold value; and in a second diagnosis stage in which the on-off valve is in the close state according to the instruction from the control section after completion of the first leak diagnosis, the diagnosis section performs a second leak diagnosis, using a pressure fluctuation detection method based on a relationship between the tank internal pressure detected by the tank internal pressure detection section and a predetermined second threshold value, the double differentiation method, and the stagnation time method.

After the first leak diagnosis is completed, the on-off valve is once opened according to the instruction from the control section. If a result of the second leak diagnosis using the pressure fluctuation detection method is an abnormal state with leak, the diagnosis section determines an abnormal state with leak, regardless of a result of the second leak diagnosis using the double differentiation method or the stagnation time method.

According to aspect (8) of the invention, in a case that a result of the second leak diagnosis using the pressure fluctuation detection method is an abnormal state with leak, the diagnosis section determines an abnormal state with leak, regardless of a result of the second leak diagnosis using the double differentiation method or the stagnation time method. Accordingly, a leak diagnosis of an evaporated fuel tightly-closed system can be performed in a shorter time, compared with aspect (6) of the invention.

An evaporated fuel treatment apparatus according to the invention enables performing leakage diagnosis, with high accuracy, of an evaporated fuel tightly-closed system, for example, even in a case of applying the invention to a hybrid vehicle.

DETAILED DESCRIPTION OF THE PREFERRED EMBODIMENTS

Figure 1:
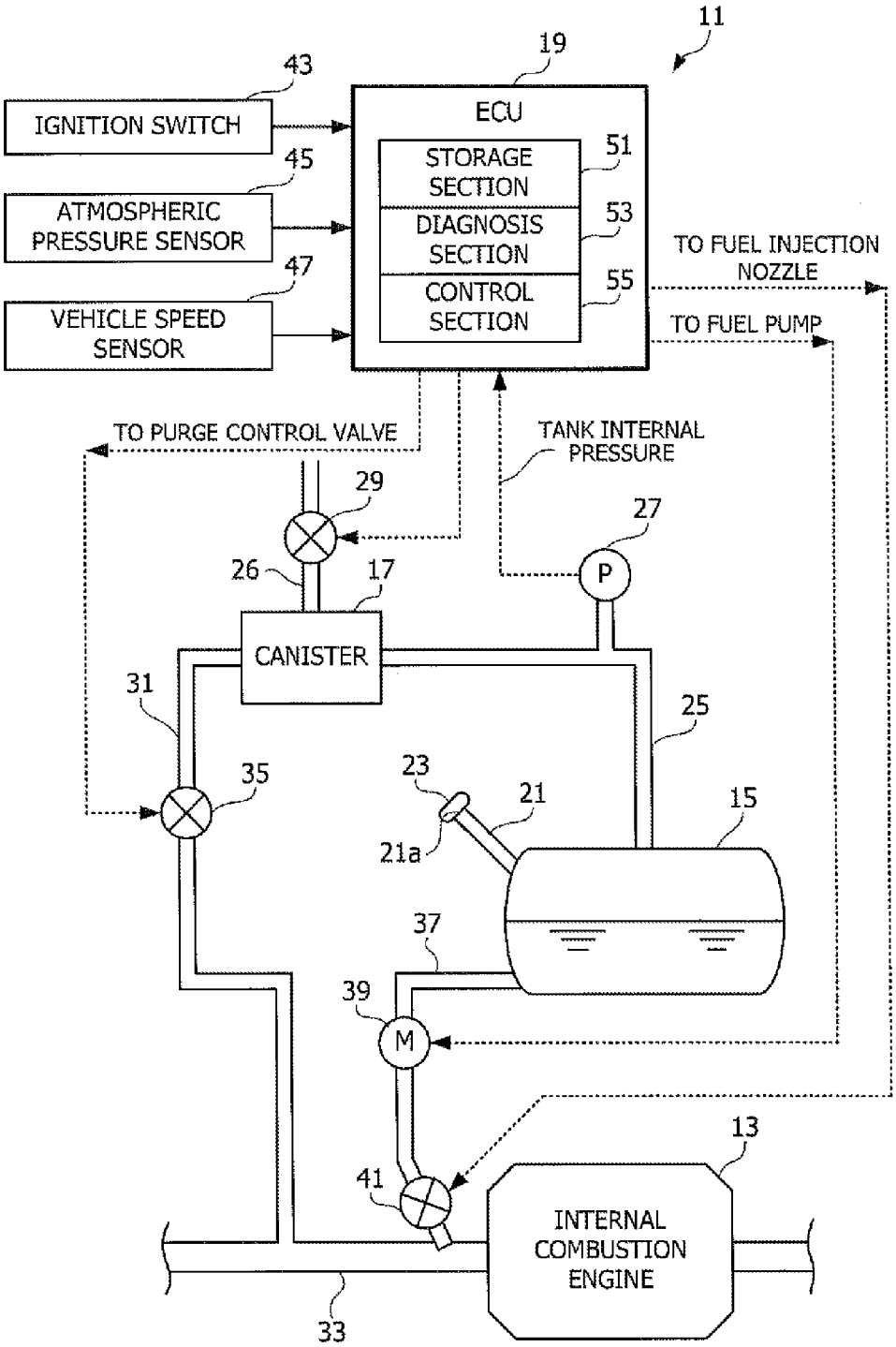
FIG. 1 is an entire configuration diagram showing the overview of an evaporated fuel treatment in an embodiment according to the present invention.

Evaporated fuel treatment apparatuses in embodiments according to the present invention will be described below, referring to the drawings.

Overview of an Evaporation Fuel Treatment apparatus 11 in an Embodiment of the Invention First, overview of an evaporated fuel treatment apparatus 11 in an embodiment according to the invention will be described with reference to FIG. 1, taking an example applied to a hybrid vehicle provided with an internal combustion engine 13 and an electric motor (not shown) as driving sources. FIG. 1 is an entire configuration diagram showing the overview of an evaporated fuel treatment apparatus 11 in an embodiment according to the present invention.

Incidentally, the same reference symbol will be assigned to the same member or corresponding members in the drawings described below. The size and the shape of a member may be schematically represented with deformation or exaggeration for the convenience of illustration.

As shown in FIG. 1, the evaporated fuel treatment apparatus 11 taking the role of treating evaporated fuel is provided with a fuel tank 15 for reserving fuel such as gasoline, the fuel tank 15 being mounted on a vehicle having an internal combustion engine 13, a canister 17 having a function to absorb evaporated fuel generated in the fuel tank 15, and an ECU (Electronic Control unit) 19 performing integrated control of the evaporated fuel treatment apparatus 11.

The fuel tank 15 is provided with a fuel inlet pipe 21. A fuel fill opening 21*a*, into which the nozzle of a fuel fill gun (neither not shown) is inserted, is provided on the side of the fuel inlet pipe 21 opposite to the fuel tank 15 side. A screw type filler cap 23 is fitted to the fuel fill opening 21*a*.

The fuel tank 15 is provided with an evaporated fuel exhaust passage 25 for communication and connection between the fuel tank 15 and the canister 17. The evaporated fuel exhaust passage 25 has a function as a flow passage of the evaporated fuel. The canister 17 is provided with an atmospheric air flow passage 26 for communication and connection between the canister 17 and the atmosphere. The atmospheric air flow passage 26 has a function as a flow passage of atmospheric air. The evaporated fuel exhaust passage 25 and the atmospheric air flow passage 26 are corresponding to 'communication passage' according to the invention.

The evaporated fuel exhaust passage 25 is provided with a tank internal pressure sensor 27. The tank internal pressure sensor 27 corresponds to 'tank internal pressure detection section' according to the invention. The tank internal pressure sensor 27 has a function to detect tank internal pressure Ptank that is a pressure in the gas phase region in the fuel tank 15. Alternately, arrangement may be made such that the tank internal pressure sensor 27 is provided directly to the fuel tank 15. As the pressure detection section of the tank internal pressure sensor 27, for example, a piezoelectric element can be used. Information regarding the tank internal pressure Ptank detected by the tank internal pressure sensor 27 is sent to the ECU 19.

Incidentally, when the canister 17 is communicating with the atmosphere by opening an atmosphere on-off valve 29, the tank internal pressure sensor 27 can detect the atmospheric pressure. On the other hand, when a later-described 'evaporated fuel tightly-closed system' is formed by closing the atmosphere on-off valve 29 and a purge control valve 35, the tank internal pressure sensor 27 can detect the fluctuation of the tank internal pressure Ptank of the fuel tank 15. The atmospheric air flow passage 26 is provided with the atmosphere on-off valve 29. The atmosphere on-off valve 29 corresponds to 'on-off valve' according to the invention. The atmosphere on-off valve 29 has a function to open or close the inner space of the canister 17 to/from the atmosphere. Concretely, the atmosphere on-off valve 29 is a normally-closed electromagnetic valve that operates according to a control signal transmitted from the ECU 19. When current is not applied, the atmosphere on-off valve 29 is closed so that the canister 17 and the atmosphere are shielded from each other, and when the atmosphere on-off valve 29 is opened, according to an open control signal from the ECU 19, the canister 17 and the atmosphere communicate with each other.

The canister 17 contains an absorbing member (not shown) of activated carbon for absorbing evaporated fuel. The absorbing member of the canister 17 absorbs evaporated fuel transferred from the fuel tank 15 side through the evaporated fuel exhaust passage 25. The canister 17 is communicated and connected with, in addition to the atmospheric air flow passage 26, a purge communication passage 31 used in performing purge processing. The canister 17 is communicated and connected with an intake pipe (intake manifold) 33 through the purge communication passage 31.

In the purge processing, by opening a purge control valve 35 described below, the evaporated fuel absorbed by the absorbing member of the canister 17 is transferred to the intake pipe 33 through the purge communication passage 31, together with air taken in through the atmospheric air flow passage 26.

The purge communication passage 31 is provided with the purge control valve 35. The purge control valve 35 has a function to open or close the purge communication passage 31 for communication and connection between the canister 17 and the intake pipe 33. Concretely, the purge control valve 35 is a normally-open electromagnetic valve that operates, according to a control signal transmitted from the ECU 19. The purge control valve 35 shields the canister 17 and the intake pipe 33 from each other by being closed when current is not applied, and on the other hand, operates to make the canister 17 and the intake pipe 33 communicate with each other by being opened, according to an open control signal from the ECU 19.

Herein, 'evaporated fuel tightly-closed system' according to the invention refers to a closed space partitioned by the fuel tank 15, the evaporated fuel exhaust passage 25, the canister 17, the atmospheric air flow passage 26 and the atmosphere on-off valve 29, and the purge communication passage 31 and the purge control valve 35.

The fuel tank 15 and the intake pipe 33 are communicated and connected with each other through a fuel supply passage 37. The fuel supply passage 37 is provided with a fuel pump module 39 for pumping up fuel reserved in the fuel tank 15 and supplying out the fuel to a fuel injection nozzle 41. The fuel injected from the fuel injection nozzle 41 is supplied to the internal combustion engine 13 in a state of mixture with air supplied from the intake pipe 33.

As shown in FIG. 1, the ECU 19 is connected with, as an input system, the above-described tank internal pressure sensor 27, an ignition switch 43, an atmospheric pressure sensor 45, and a vehicle speed sensor 47. The vehicle speed sensor 47 has a function to detect the speed of the own vehicle (not shown). Information related to the speed of the own vehicle detected by the vehicle speed sensor 47 is transmitted to the ECU 19.

Further, as shown in FIG. 1, the ECU 19 is connected with, as an output system, the above-described atmosphere on-off valve 29, the purge control valve 35, the fuel pump module 39, and the fuel injection nozzle 41.

As shown in FIG. 1, the ECU 19 is provided with a storage section 51, a diagnosis section 53, and a control section 55. The ECU 19 is configured by a microcomputer including a CPU (Central Processing Unit), a ROM (Read Only Memory), a RAM (Random Access Memory), and the like. This microcomputer reads out and executes programs and data stored in the ROM, and operates such as to perform integrated control of the entire of the leak diagnosis function of the ECU 19 and the evaporated fuel treatment apparatus 11.

The storage section 51 has a function to store a first threshold value P_th1, a second threshold value P_th2, a first diagnosis period dt1 related to a first diagnoses stage, a second diagnosis period dt2 related to a second leak diagnosis, a preset open time period ot of the atmosphere on-off valve 29, and the like. The preset open time period ot of the atmosphere on-off valve 29 can be set, as appropriate, to a time length that is long enough for the pressure (tank internal pressure Ptank) of the evaporated fuel tightly-closed system to be reset to the atmospheric pressure.

The first and second threshold values P_th1 and P_th2, the first and second diagnosis periods dt1 and dt2, and the preset open time period ot of the atmosphere on-off valve 29 are referred to, as appropriate, in performing, for example, leak diagnosis by the diagnosis section 53 in the first and second diagnosis stages described later.

The diagnosis section 53 has a function to perform leak diagnosis of the evaporated fuel tightly-closed system. This function will be described below in more details. That is, after the ignition switch 43 of the own vehicle is turned off, in the first diagnosis stage where the atmosphere on-off valve 29 is closed according to a closing instruction from the control section 55, the diagnosis section 53 performs the first leak diagnosis, based on the relationship between a tank internal pressure Ptank by the tank internal pressure sensor 27 and the first threshold value P_th1, and after performing the first leak diagnosis, in the second diagnosis stage where the atmosphere on-off valve 29 is closed according to a closing instruction from the control section 55, the diagnosis section 53 performs the second leak diagnosis, based on the relationship between a tank internal pressure Ptank detected by the tank internal pressure sensor 27 and the second threshold value P_th2.

Herein, in an embodiment according to the invention, for a method of leak diagnosis of the evaporated fuel tightly-closed system, a pressure fluctuation detection method (hereinafter, referred to as 'PFD method'), a double differentiation method (hereinafter, referred to as 'DDP method'), and a stagnation time method (hereinafter, referred to as 'DTM method') will be used. In performing leak diagnosis using PFD method, DDP method, and DTM method, it is assumed that an evaporated fuel tightly-closed system is formed (The atmosphere on-off valve 29 and the purge control valve 35 are in a closed state).

Incidentally, a leak diagnosis method by DDP method and DTM method are described in detail, for example, in Japanese Patent Application Laid-Open No. 2006-77595. This patent application publication is incorporated by reference in the specification of present application. Accordingly, only overview of the leak diagnosis method by DDP method and DTM method will be described here.

First, a principle common to leak diagnosis methods related to PFD method, DDP method, and DTM method will be described below. In general, assuming that an evaporated fuel tightly-closed system is formed in a normal state (without leak), when a certain time has elapsed from a time when the internal combustion engine 13 was stopped (turning off the ignition switch 43), the tank internal pressure Ptank deviates from the vicinity of the atmospheric pressure (a certain allowable range including the atmospheric pressure) in most cases. This is because inside the fuel tank 15 of a parked vehicle, in general, evaporated fuel is generated from the effect of residual heat of the internal combustion engine 13 or the ambient temperature.

However, if the evaporated fuel tightly-closed system including the fuel tank 15 has a leak, the temporal characteristic of the tank internal pressure Ptank shows a special tendency, such as convergence to the vicinity of the atmospheric pressure. Accordingly, based on whether or not the temporal characteristic of the tank internal pressure Ptank shows the above-described special tendency, it is possible to make a diagnosis as to whether or not an evaporated fuel tightly-closed system has a leak.

The overview of PFD method will be described below. When the evaporated fuel tightly-closed system is in a normal state (without leak), the temporal characteristic of the tank internal pressure Ptank detected by the tank internal pressure sensor 27 tends to increase substantially linearly with a relatively large gradient. On the other hand, when the evaporated fuel tightly-closed system is in an abnormal state (with leak), it tends to that, in most cases, the temporal characteristic of the tank internal pressure Ptank at first increases with a relatively large variation rate (the gradient of the temporal characteristic graph of the tank internal pressure Ptank), however, the tank internal pressure Ptank plateaus at a certain pressure level corresponding to the diameter of a hole, and then the variation rate (the gradient of the temporal characteristic graph) gradually decreases.

Accordingly, it is possible to make a diagnosis as to whether or not the evaporated fuel tightly-closed system has a leak by evaluating the tendency of the temporal characteristic of the tank internal pressure Ptank. Concretely, a leak diagnosis is made, based on the relationship between a tank internal pressure Ptank and predetermined threshold values (for example, the first threshold value P_th1 and the second threshold value P_th2). If the tank internal pressure Ptank detected by the tank internal pressure sensor 27 has exceeded the threshold value/values (for example, the first threshold value P_th1 and the second threshold value P_th2), the diagnosis determines that the evaporated fuel tightly-closed system is in a normal state (without a leak).

Therefore, according to PFD method, a leak diagnosis of the evaporated fuel tightly-closed system can be made by determining as to whether or not the tank internal pressure Ptank, which is detected after stopping the internal combustion engine 13 (turning off the ignition switch 43), has exceeded a threshold (for example, the first threshold value P_th1 and the second threshold value P_th2).

The overview of DDP method will be described below. If the evaporated fuel tightly-closed system is in a normal state (without a leak), the temporal characteristic of the tank internal pressure Ptank detected by the tank internal pressure sensor 27 tends to increase substantially linearly with a relatively large gradient. On the other hand, if the evaporated fuel tightly-closed system is in an abnormal state (with a leak), it tends to that, in most cases, the temporal characteristic of the tank internal pressure Ptank at first increases with a relatively large variation rate (the gradient of the temporal characteristic graph of the tank internal pressure Ptank), however, the tank internal pressure Ptank plateaus at a certain pressure level corresponding to the diameter of the hole, and then the variation rate (the gradient of the temporal characteristic graph) gradually decreases.

Therefore, it is possible to make a diagnosis as to whether or not an evaporated fuel tightly-closed system has a leak by evaluating the tendency of the temporal characteristic of the above-described tank internal pressure Ptank. Concretely, in order to make a leak diagnosis with high accuracy even if the generation amount of the evaporated fuel fluctuates with time, the double differential value (can also be the correlation value of the double differential value) obtained by twice differentiating the tank internal pressure Ptank is used as a determination parameter. Then, the determination parameter becomes approximately '0' when the evaporated fuel tightly-closed system is in a normal state, and the determination parameter becomes a negative value when the evaporated fuel tightly-closed system is in an abnormal state.

Accordingly, by DDP method, a leak diagnosis of an evaporated fuel tightly-closed system can be made by evaluating the value of a determination parameter.

However, by the above-described DDP method, it is difficult to detect a leak abnormality in case that a comparatively small hole is made through the evaporated fuel tightly-closed system and the gradient of a temporal characteristic graph of the tank internal pressure Ptank is gradual. The following DTM method is effective in a case that leak abnormality is caused by a small hole (hereinafter, referred to as 'small hole leak') as described above.

In DTM method, first, the time period of (continuous) convergence of the tank internal pressure Ptank detected by the tank internal pressure sensor 27 in a certain pressure range is defined as stagnation time TSTY. Then, making x-axis represent the tank internal pressure Ptank and y-axis represent the stagnation time TSTY, a correlation characteristic graph representing the transition of the stagnation time TSTY accompanying change in the tank internal pressure Ptank is created, and a regression graph of the correlation characteristic graph is drawn. If attention is focused on the gradient of the regression graph of the correlation characteristic graph representing the transition of the stagnation time TSTY accompanying change in the tank internal pressure Ptank, in case that the evaporated fuel tightly-closed system is in a normal state (without a leak), the gradient of the regression graph is of a relatively small positive value, and on the other hand, in case that the evaporated fuel tightly-closed system is in an abnormal state (with a leak), the gradient of the regression graph is of a negative value with a large absolute value.

Thus, by DTM method, depending on whether the gradient of the regression graph of the correlation characteristic graph is of a positive value or a negative value, and by evaluation of the magnitude relationship, the existence or non-existence of leak of the evaporated fuel tightly-closed system can be diagnosed, including small hole leak.

The control section 55 has a function to perform integrated control of the entire evaporated fuel treatment apparatus 11. Further, the control section 55 also has a function to issue an instruction to close the atmosphere on-off valve 29 and the purge control valve 35, for example, after the ignition switch 43 is turned off (The internal combustion engine 13 is stopped). Incidentally, if an arrangement is adopted such that current supply to the purge control valve 35 is stopped when the ignition switch 43 is turned off, it is possible to configure the control section 55, omitting the function to issue an instruction to close the purge control valve 35.

Operation of the Evaporation Fuel Treatment apparatus 11 in an Embodiment According to the Invention The operation of an evaporated fuel treatment apparatus 11 in an embodiment according to the invention will be described below, referring to FIG. 2A.

Figure 2A:
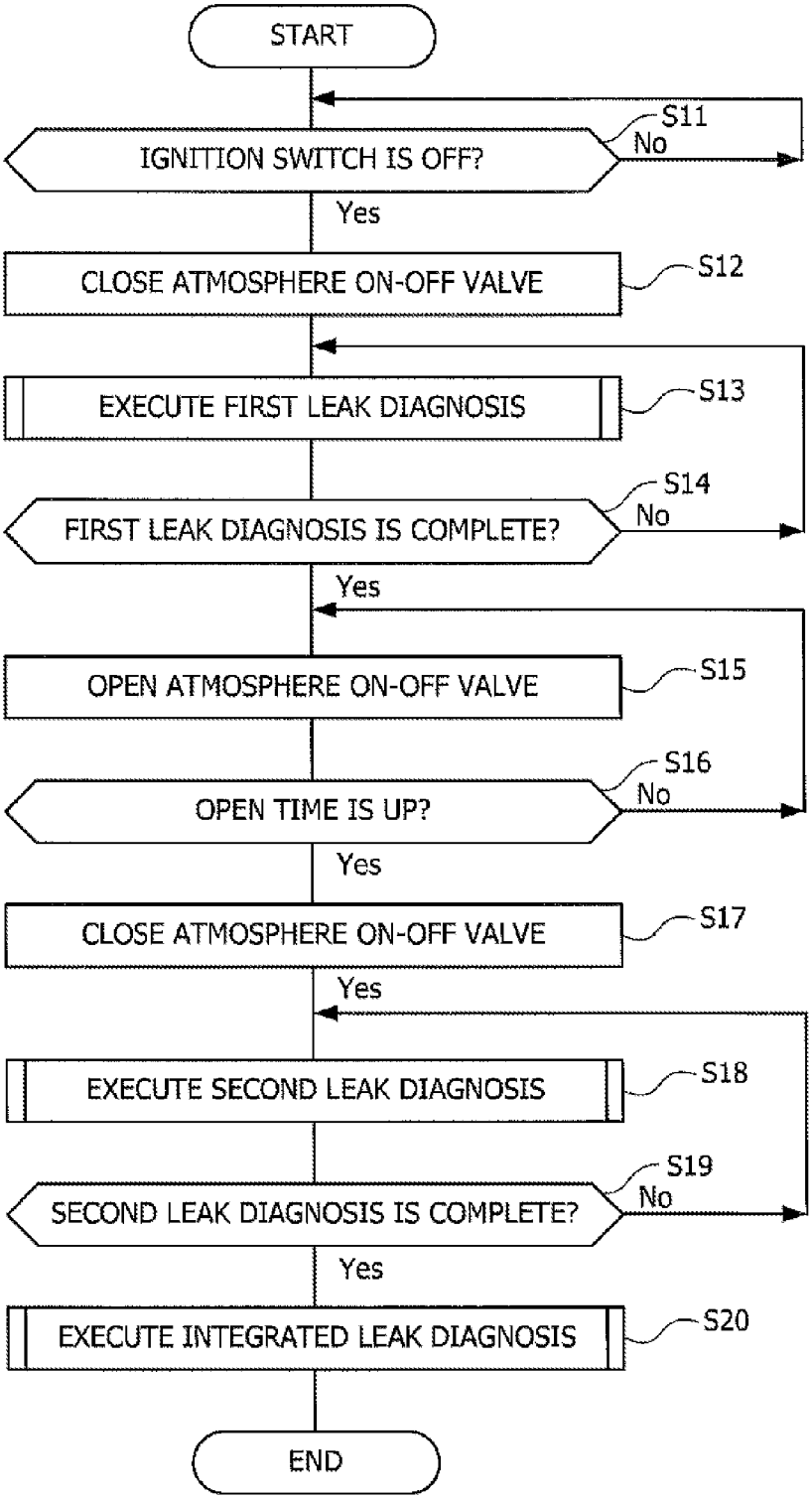
FIG. 2A is a flowchart diagram showing the flow of a leak diagnosis process performed by the evaporated fuel treatment apparatus in an embodiment according to the invention.

FIG. 2A is a flowchart diagram showing the flow of a leak diagnosis process performed by an evaporated fuel treatment apparatus in an embodiment according to the invention.

In step S11 shown in FIG. 2A, the ECU 19 checks whether or not the ignition switch 43 has been turned off. The ECU 19 repeats the determination processing in step S11 until it is determined that the ignition switch 43 has been turned off.

As a result of the determination in step S11, if it is determined that the ignition switch 43 has been turned off ('Yes' in step S11), then the ECU 19 makes the flow of the process proceed to the next step S12.

In step S12, the control section 55 of the ECU 19 performs control to make the atmosphere on-off valve 29 into a close state. When the atmosphere on-off valve 29 is thus closed, and the purge control valve 35 is closed (by stopping current supply), an evaporated fuel tightly-closed system is formed, and preparation for a leak diagnosis is thereby complete.

In step S13, the diagnosis section 53 performs the first leak diagnosis. The first leak diagnosis is the procedure of a leak diagnosis, of the evaporated fuel tightly-closed system, that is performed by the diagnosis section 53 in the first diagnosis stage beginning immediately after the turning off of the ignition switch 43 and uses PFD method (pressure fluctuation detection method). The first diagnosis period dt1 of the first diagnosis stage is within a stabilizing time period that is started at the turning off time of the ignition switch 43 and is supposed to be required for stabilization of the tank internal pressure Ptank detected by the tank internal pressure sensor 27, in comparison with the state immediately after the ignition switch 43 is turned off. The first diagnosis period dt1 is set to a time length shorter than the second diagnosis period d of the second diagnosis stage described later. The first leak diagnosis will be described in detail later.

In step S14, the ECU 19 refers to the first diagnosis period dt1 stored in the storage section 51, and checks whether or not the elapsed time from the turning off of the ignition switch 43 has reached the first diagnosis period dt1 (whether or not the first leak diagnosis is complete.) The ECU 19 repeats the determination processing of step S14 until it is determined that the elapsed time from the turning off of the ignition switch 43 has reached the first diagnosis period dt1 (The first leak diagnosis is complete.)

As a result of the determination in step S14, if it is determined that the elapsed time from the time of turning off the ignition switch 43 has reached the first diagnosis period dt1 (The first leak diagnosis is complete.) ('Yes' in step S14), the ECU 19 makes the flow of the process proceed to the next step S15.

In step S15, the control section 55 of the ECU 19 performs control to make the atmosphere on-off valve 29 into an open state. When the atmosphere on-off valve 29 is thus opened, the tank internal pressure Ptank detected by the tank internal pressure sensor 27 converges to the atmospheric pressure.

In step S16, the ECU 19 refers to the preset open time period ot of the atmosphere on-off valve 29 stored in the storage section 51, and thereby checks whether or not the open time period of the atmosphere on-off valve 29 has reached the preset open time period ot. The ECU 19 repeats the determination processing of step S16 until it is determined that the open time period of the atmosphere on-off valve 29 has reached the preset open time period ot of the atmosphere on-off valve 29.

As a result of the determination in step S16, if it is determined that the open time period of the atmosphere on-off valve 29 has reached the preset open time period ot of the atmosphere on-off valve 29 ('Yes' in step S16), then the ECU 19 makes the flow of the process proceed to the next step S17.

In step S17, the ECU 19 performs control to switch the atmosphere on-off valve 29 from the open state to the close state. When the atmosphere on-off valve 29 is thus closed (the close state of the purge control valve 35 being maintained by stopping current supply), an evaporated fuel tightly-closed system is formed, and preparation for a leak diagnosis is thereby complete.

In step S18, the diagnosis section 53 performs the second leak diagnosis. The second leak diagnosis is the procedure of a leak diagnosis, of the evaporated fuel tightly-closed system, that is performed by the diagnosis section 53 in the second diagnosis stage in which the atmosphere on-off valve 29 is in the close state. Herein, prior to the second leak diagnosis stage in which the atmosphere on-off valve 29 is in the close state, the first leak diagnosis is completed and then the atmosphere on-off valve 29 is once opened, according to a closing instruction from the control section 55. The second leak diagnosis uses a combination of PFD method (pressure fluctuation detection method), DDP method (double differentiation method), and DTM (stagnation time method). The second diagnosis period dt2 of the second leak diagnosis is set sufficiently longer than the first diagnosis period dt2 . The second leak diagnosis will be described later in detail.

In step S19, the ECU 19 refers to the second diagnosis period dt2 stored in the storage section 51, and thereby checks whether or not the elapsed time, from when the atmosphere on-off valve 29 has been switched from the open state to the close state, has reached the second diagnosis period dt2 (whether or not the second leak diagnosis is completed.) The ECU 19 repeats the determination processing of step S19 until it is determined that the elapsed time, from when the atmosphere on-off valve 29 has been switched from the open state to the close state, has reached the second diagnosis period dt2 (The second leak diagnosis is completed.)

As a result of step S19, when it is determined that the elapsed time, from when the atmosphere on-off valve 29 has been switched from the open state to the close state, has reached the second diagnosis period dt2 (The second leak diagnosis is completed.)('Yes' in step S19), then the ECU 19 makes the flow of the process proceed to step S20.

In a subroutine of step S20, the diagnosis section 53 of the ECU 19 performs an integrated leak diagnosis. The integrated leak diagnosis is the procedure of leak diagnosis of the evaporated fuel tightly-closed system performed by the diagnosis section 53 after completion of the first and second leak diagnoses, to obtain a result of an integrated leak diagnosis that is the integration of the results of the first and second leak diagnoses. The integrated leak diagnosis will be described below in detail.

Integrated Leakage Diagnosis Performed by the Evaporation Fuel Treatment Apparatus 11 in an Embodiment According to the Invention In the following, an integrated leak diagnosis performed by an evaporated fuel treatment apparatus 11 in an embodiment according to the invention will be described, referring to FIG. 2B.

Figure 2B:
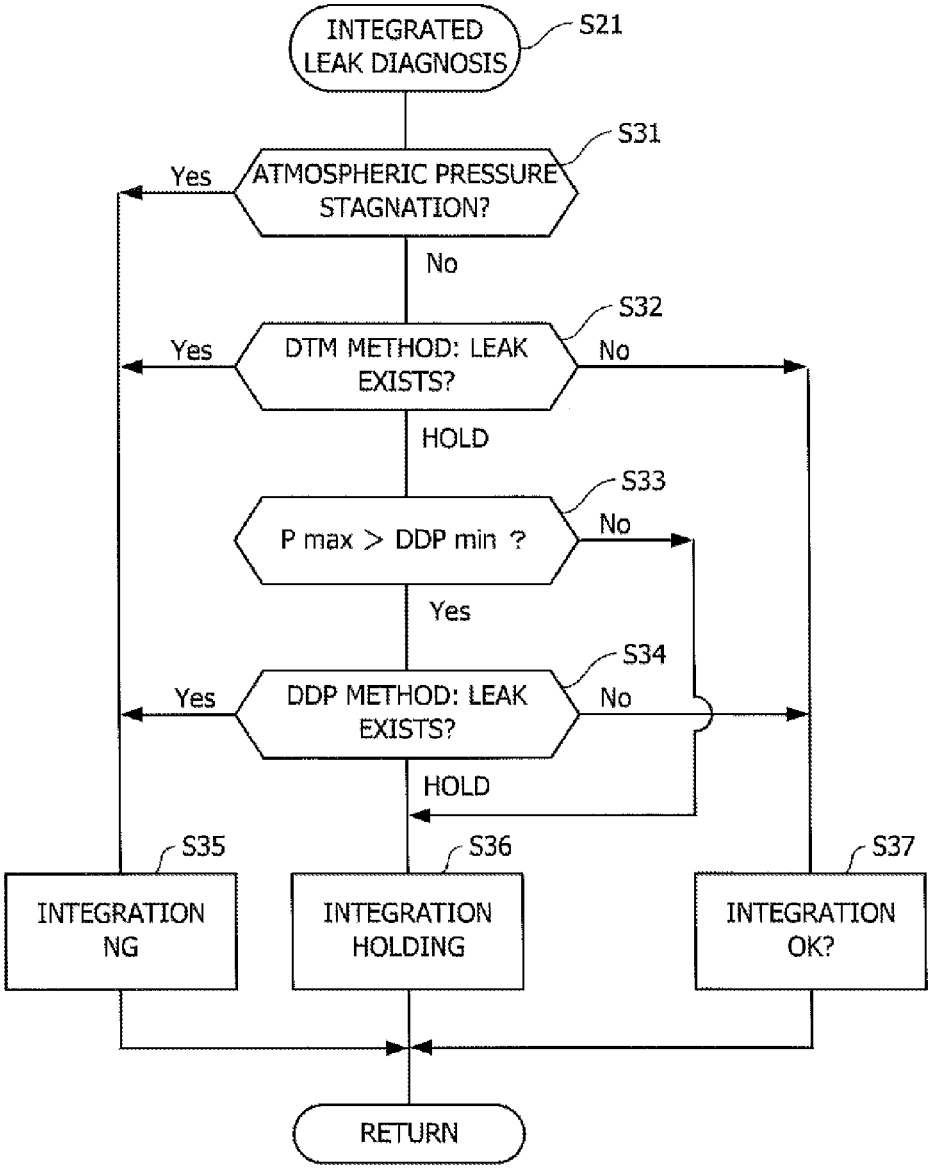
FIG. 2B is a flowchart diagram showing the flow of integrated leak diagnosis performed by an evaporated fuel treatment apparatus in an embodiment according to the invention.

FIG. 2B is a flowchart diagram showing the flow of the integrated leak diagnosis performed by an evaporated fuel treatment apparatus 11 in an embodiment according to the invention.

The integrated leak diagnosis according to the subroutine of step S20 shown in FIG. 2B is performed by the diagnosis section 53 after results of the first and second leak diagnoses are obtained.

Incidentally, as described above, in the first leak diagnosis, a leak diagnosis of the evaporated fuel tightly-closed system is performed, using PFD method (pressure fluctuation detection method). In the second leak diagnosis, a leak diagnosis of the evaporated fuel tightly-closed system is performed, using PFD method (pressure fluctuation detection method), DDP method (double differentiation method), and DTM method (stagnation time method).

In step S31 shown in FIG. 2B, based on the result of the second leak diagnosis using PFD method (pressure fluctuation detection method), the diagnosis section 53 checks whether or not the tank internal pressure Ptank detected by the tank internal pressure sensor 27 is stagnating in the vicinity of the atmospheric pressure. Concretely, for example, in the second diagnosis period dt2 of the second diagnosis stage, if the tank internal pressure Ptank detected by the tank internal pressure sensor 27 is converging in the vicinity of the atmospheric pressure (in a certain allowed range including the atmospheric pressure), the diagnosis section 53 determines as a result of the diagnosis that the tank internal pressure Ptank is stagnating in the vicinity of the atmospheric pressure.

As a result of the determination in step S31, if it is determined that the tank internal pressure Ptank is not stagnating in the vicinity of the atmospheric pressure ('No' in step S31), then the diagnosis section 53 makes the flow of the process to the next step S32.

On the other hand, as a result of the determination in step S31, if it is determined that the tank internal pressure Ptank is stagnating in the vicinity of the atmospheric pressure ('Yes' in step S31), then diagnosis section 53 makes the flow of the process jump to 'integration NG' in step S35.

Incidentally, 'integration NG' means that the result of the integrated leak diagnosis by integration of the first and second leak diagnoses is 'NG (abnormality with leak)'.

In step S32, the diagnosis section 53 determines if the result of the second leak diagnosis using DTM method (stagnation time method) is abnormality with leak, normality without leak, or holding due to impossibility of diagnosis.

As a result of determination by the second leak diagnosis using DTM method in step S32, if holding due to impossibility of diagnosis is determined ('holding' in step S32), then the diagnosis section 53 makes the flow of the process proceed to the next step S33.

As a result of determination by the second leak diagnosis using DTM method in step S32, if abnormality with leak is determined ('Yes' in step S32), then the diagnosis section 53 makes the flow of the process jump to 'integration 'NG' in step S35.

Further, as a result of determination by the second leak diagnosis using DTM method in step S32, if normality without leak is determined ('No' in step S32), then the diagnosis section 53 makes the flow of the process jump to 'integration OK' in step S37.

Incidentally, 'integration OK' means that the result of integrated leak diagnosis is 'OK (normality without leak)'.

In short, arrangement is made such that if either abnormality with leak or normality without leak is determined as a result of the second leak diagnosis using DTM method in step S32, a result of integrated leak diagnosis is determined using, giving priority to, the result of the second leak diagnosis using DTM method (stagnation time method), regardless of a result of the second leak diagnosis using DDP method (double differentiation method) in step S34. This is because, in general, a result of leak diagnosis with a higher accuracy can be obtained by DTM method, compared with DDP method.

In step S33, the diagnosis section 53 determines, in the second diagnosis stage, whether or not the maximum value Pmax of the tank internal pressure Ptank detected by the tank internal pressure sensor 27 is exceeding the minimum value DDPmin of the tank internal pressure Ptank that enables leak diagnosis using DDP method.

In DDP method, in case that the maximum value Pmax of the tank internal pressure Ptank detected by the tank internal pressure sensor 27 is lower than the minimum value DDPmin, of the tank internal pressure Ptank, that is the lower limit for application of DDP method, it is difficult to appropriately perform leak diagnosis of the evaporated fuel tightly-closed system.

Step S33 enables simple and quick judgment as to whether or not a leak diagnosis using DDP method in the second diagnosis stage is effective.

Incidentally, the minimum value DDPmin, of the tank internal pressure Ptank, that enables leak diagnosis using DDP method may be a predetermined fixed value and may be a variable value corresponding to a parameter related to DDP method.

As a result of the determination in step S33, if determination is made such that the maximum value Pmax of the tank internal pressure Ptank is exceeding the minimum value DDPmin of the tank internal pressure Ptank, the minimum value DDPmin enabling leak diagnosis using DDP method, ('Yes' in step S33), the diagnosis section 53 makes the flow of the process jump to the next step S34.

On the other hand, as a result of the determination in step S33, if determination is made that the maximum value Pmax of the tank internal pressure Ptank is not exceeding the minimum value DDPmin of the tank internal pressure Ptank, the minimum value DDPmin enabling leak diagnosis using DDP method, ('No' in step S33), the diagnosis section 53 makes the flow of the process jump to 'integration holding' in step S36.

Herein, 'integration holding' means that the result of the integrated leak diagnosis is 'holding (including cases that diagnosis for determination of normality or abnormality is impossible).

In step S34, the diagnosis section 53 determines as to whether the result of the second leak diagnosis using DDP method is abnormality with leak, normality without leak, or holding due to impossibility of diagnosis.

As a result of the determination in step S34, if the result of the second leak diagnosis using DDP method is determined to be holding ('holding' in step S32), the diagnosis section 53 makes the flow of the process proceed to 'integration holding determined' in step S36.

As a result of determination in step S34, if the result of the second leak diagnosis using DDP method is determined to be abnormality with leak ('Yes' in S34), the diagnosis section 53 makes the flow of the process jump to 'integration NG' in step S35.

As a result of determination in step S34, if the result of second leak diagnosis using DDP method is determined to be normality without leak ('No' in S34), the diagnosis section 53 makes the flow of the process jump to 'integration OK' in step S37.

In short, in determining a result of the second leak diagnosis using DDP method in step S34, if it is determined that the tank internal pressure Ptank is not stagnating in the vicinity of the atmospheric pressure as a result of the second leak diagnosis using PFD method in step S31 and if a result of the second leak diagnosis using DTM method in step S32 is holding, then a result of integrated leak diagnosis is determined, using a result, as it is, of the second leak diagnosis using DDP method, wherein DDP method has a lower leak diagnosis accuracy compared with DTM method.

Time Series Operation of the Evaporated Fuel Treatment Apparatus in a Comparative Example In the following, the time series operation of an evaporated fuel treatment apparatus in a comparative example will be described, referring to FIGS. 3A-3D and FIGS. 3E-3H.

FIGS. 3A-3D are time chart diagrams for illustrating the operation of the evaporated fuel treatment apparatus (in a normal state without leak) of a comparative example after switching the ignition switch 43 from ON to OFF. FIGS. 3E-3H are time chart diagrams for illustrating the operation of the evaporated fuel treatment apparatus (in an abnormal state with leak) of the comparative example after switching the ignition switch 43 from ON to OFF.

Incidentally, an evaporated fuel treatment apparatus 11 in an embodiment according to the invention and the evaporated fuel treatment apparatus of the comparative example are mainly different in the following two points.

The first difference is that an evaporated fuel treatment apparatus 11 in an embodiment according to the invention performs leak diagnosis (in a close state of the atmosphere on-off valve 29) in the first diagnosis stage (within a stabilizing time period supposed to be required for stabilization in comparison with the state immediately after the ignition switch 43 is turned off), and on the other hand, the evaporated fuel treatment apparatus of the comparative example does not perform leak diagnosis within a time period corresponding to the first diagnosis stage (The open state of the atmosphere on-off valve 29 is maintained).

The second difference is as follows. On an evaporated fuel treatment apparatus 11 in an embodiment according to the invention, in the second diagnosis stage (after elapse of the stabilizing time period supposed to be required for stabilization compared with the state immediately after the ignition switch 43 is turned off), a result of leak diagnosis by DTM method is adopted being given priority as a result of integrated leak diagnosis, and a result of leak analysis by DDP method is secondarily adopted as a result of integrated leak diagnosis in a case that the result of leak diagnosis by DDM method is holding (including impossibility of diagnosis). On the other hand, on the evaporated fuel treatment apparatus in the comparative example, a result of the leak diagnosis using DDP method is adopted being given priority as a result of integrated leak diagnosis, and a result of leak diagnosis by DTM method is adopted as backup.

First, operation of the evaporated fuel treatment apparatus of the comparative example in a normal state without leak will be described below. It will be assumed that the season is spring, and the ambient temperature is for example approximately 20 degrees centigrade.

Figures 3A, 3B, 3C, 3D:
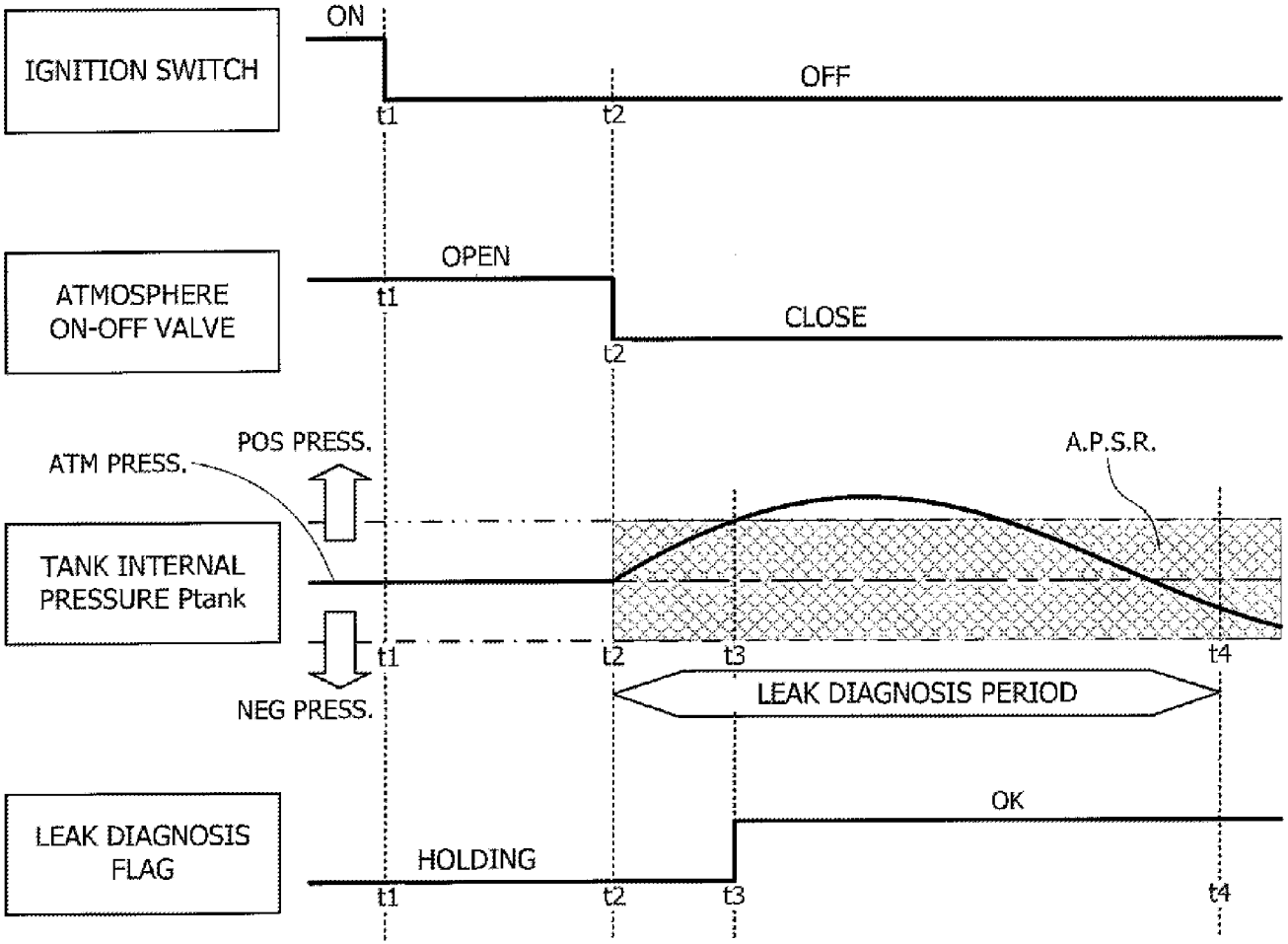
FIG. 3A is a time chart diagram for illustrating the operation of an evaporated fuel treatment apparatus (in a normal state without leak) of a comparative example after switching the ignition switch from ON to OFF.
FIG. 3B is a time chart diagram for illustrating the operation of the evaporated fuel treatment apparatus (in the normal state without leak) of the comparative example after switching the ignition switch from ON to OFF.
FIG. 3C is a time chart diagram for illustrating the operation of the evaporated fuel treatment apparatus (in the normal state without leak) of the comparative example after switching the ignition switch from ON to OFF.
FIG. 3D is a time chart diagram for illustrating the operation of the evaporated fuel treatment apparatus (in the normal state without leak) of the comparative example after switching the ignition switch from ON to OFF.

At time t1 shown in FIG. 3A, when the ignition switch 43 is turned from ON to OFF, a timer for leak diagnosis (not shown) starts counting.

At the time t1 shown in FIGS. 3B-3D, operation of respective sections belonging to the evaporated fuel treatment apparatus of the comparative example other than an ignition switch 43 is as follows. That is, an atmosphere on-off valve 29 maintains an open state (see FIG. 3B). The tank internal pressure Ptank detected by a tank internal pressure sensor 27 indicates the atmospheric pressure (see FIG. 3C). A leak diagnosis flag representing a result of leak diagnosis is in a holding state because it is before leak diagnosis (see FIG. 3D).

During time t1-t2 shown in FIG. 3A, the ignition switch 43 continues to maintain the OFF state.

During time t1-t2 shown in FIGS. 3B-3D, operation of the respective sections belonging to the evaporated fuel treatment apparatus of the comparative example other than the ignition switch 43 is the same as that at time t1 . That is, the atmosphere on-off valve 29 maintains the open state (see FIG. 3B). The tank internal pressure Ptank detected by the tank internal pressure sensor 27 indicates the atmospheric pressure (see FIG. 3C). The leak diagnosis flag is in the holding state because it is before leak diagnosis (see FIG. 3D).

At time t shown in FIG. 3B, the atmosphere on-off valve 29 is turned from the open state to a close state.

Time t2 is a timing when the count value of the timer for leak diagnosis has reached a stabilizing time supposed to be required for stabilization compared with the state immediately after the ignition switch 43 is turned off. That is, the period from time t1 to t2 shown in FIGS. 3A-3D corresponds to the first diagnosis period dt1 of the first leak diagnosis stage in an embodiment according to the invention. The evaporated fuel treatment apparatus of the comparative example does not perform leak diagnosis during the period from time t1 to t2.

During time the time t2 to t4 shown in FIG. 3C, the tank internal pressure Ptank detected by the tank internal pressure sensor 27 shows a tendency to deviate, at time t3 , from the atmospheric pressure stagnating region (A.P.S.R.)(the pressure region that has equal margins on the positive pressure side and the negative pressure side with respect to the atmospheric pressure and can be considered the vicinity of the atmospheric pressure) to the positive pressure side and thereafter converges again into the atmospheric pressure stagnating region.

Herein, the phenomenon, during when an evaporated fuel tightly-closed system is formed, that the tank internal pressure Ptank detected by the tank internal pressure sensor 27 deviates from the atmospheric pressure stagnating region (see time t3 in FIG. 3C) is a phenomenon which occurs in a case that the evaporated fuel tightly-closed system is in a normal state without leak. Thus, based on a result of leak diagnosis using PFD method and results of leak diagnoses using DDP method and DTM method, the evaporated fuel treatment apparatus of the comparative example determines that the evaporated fuel tightly-closed system is in a normal state without leak (OK state) from a view point of adopting the result of leak diagnosis by DDP method as a result of integrated leak diagnosis, giving priority to this result, and adopting the result of leak diagnosis by DTM method as backup.

The leak diagnosis period during time t2 to t4 shown in FIGS. 3A to 3D corresponds to the second leak diagnosis stage in an embodiment according to the invention. In the comparative example, similarly to an embodiment according to the invention, leak diagnoses (not shown) using DDP method and DTM method are performed in the period from time t2 to t4 , in addition to a leak diagnosis using PFD method (see elapsed time characteristic diagram of the tank internal pressure Ptank in FIG. 3C). However, as described above as the second difference, in the comparative example, arrangement is made such that the result of leak diagnosis by DDP method is adopted, being given priority, as a result of integrated leak diagnosis, and the result of leak diagnosis by DTM method is adopted as backup.

During time t2 to t4 shown in FIG. 3A, the ignition switch 43 maintains OFF state. During time t2 to t4 shown in FIG. 3B, the atmosphere on-off valve 29 maintains a close state. At time t3 shown in FIG. 3D, the leak diagnosis flag transits from a holding state to OK state, and thereafter maintains OK state until and after time t4.

The operation of the evaporated fuel treatment apparatus of the comparative example in an abnormal state with leak will be described below. Herein, as the operation during time t1 to t2 shown in FIGS. 3E-3H is the same as that in the normal state without leak described above, overlapping description will be omitted, and operation from time t2 will be described.

Figures 3E, 3F, 3G, 3H:
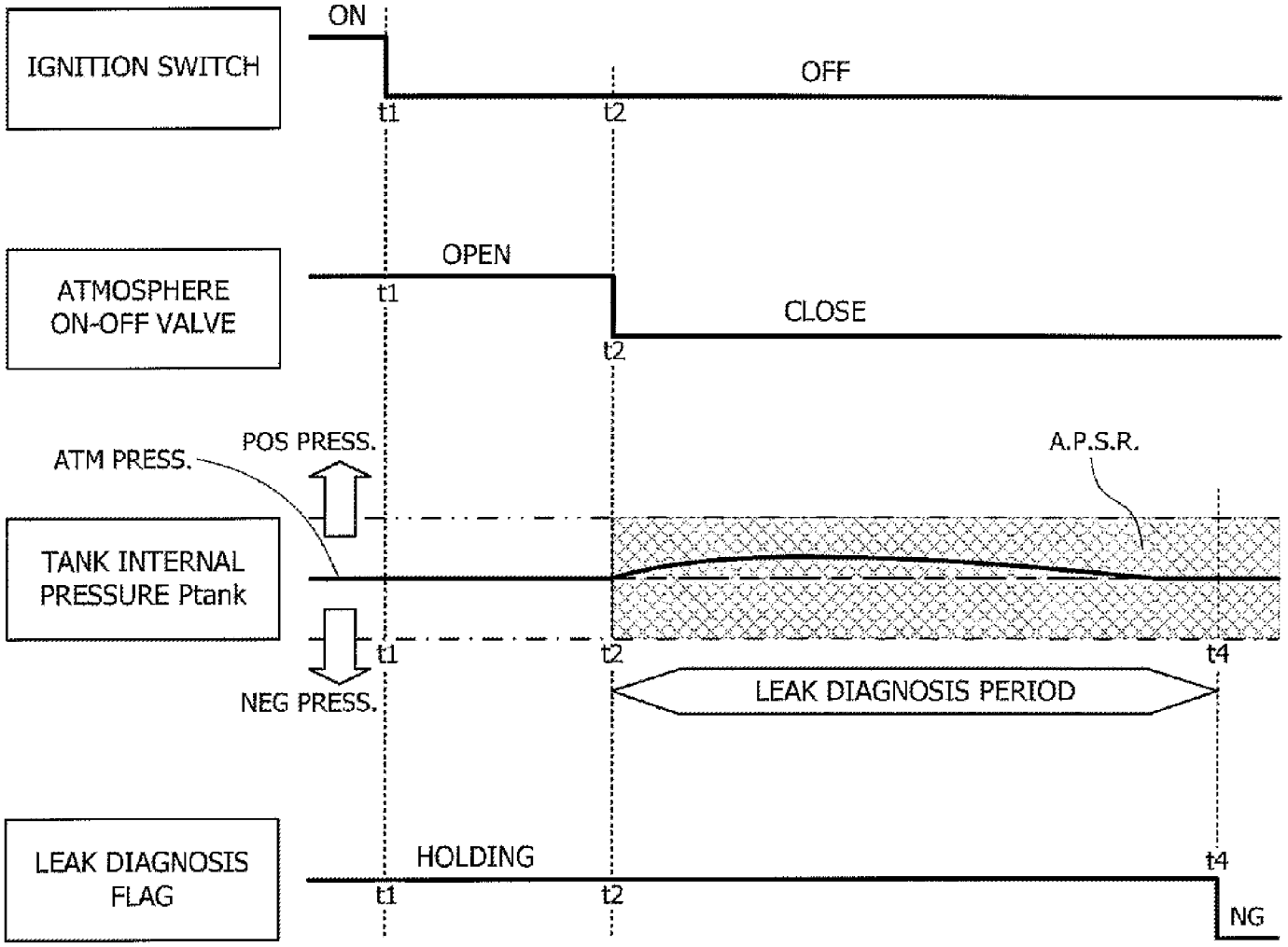
FIG. 3E is a time chart diagram for illustrating the operation of the evaporated fuel treatment apparatus (in an abnormal state with leak) of the comparative example after switching the ignition switch from ON to OFF.
FIG. 3F is a time chart diagram for illustrating the operation of the evaporated fuel treatment apparatus (in the abnormal state with leak) of the comparative example after switching the ignition switch from ON to OFF.
FIG. 3G is a time chart diagram for illustrating the operation of the evaporated fuel treatment apparatus (in the abnormal state with leak) of the comparative example after switching the ignition switch from ON to OFF.
FIG. 3H is a time chart diagram for illustrating the operation of the evaporated fuel treatment apparatus (in the abnormal state with leak) of the comparative example after switching the ignition switch from ON to OFF.

During the leak diagnosis period from t2 to t4 shown in FIG. 3G, the tank internal pressure Ptank detected by the tank internal pressure sensor 27 maintains a state converging in the atmospheric pressure stagnating region (A.P.S.R.).

Herein, the phenomenon that, while an evaporated fuel tightly-closed system is formed, the tank internal pressure Ptank detected by the tank internal pressure sensor 27 maintains the convergence state in the atmospheric pressure stagnating region is a phenomenon that occurs in a case that the evaporated fuel tightly-closed system is in an abnormal state with leak. Thus, at time t4 when the leak diagnosis period terminates, based on a result of leak diagnosis using PDF method and results of leak diagnoses using DDP method and DTM method, the evaporated fuel treatment apparatus of the comparative example determines that the evaporated fuel tightly-closed system is in an abnormal state (NG state) from a view point of adopting a result of leak diagnosis by DDP method as a result of integrated leak diagnosis, giving priority to this result, and adopting a result of leak diagnosis by DTM method as backup.

During the period from time t2 to t4 shown in FIG. 3E, the ignition switch 43 maintains OFF state. During the same period from time t2 to t4 shown in FIG. 3F, the atmosphere on-off valve 29 maintains a close state. The leak diagnosis flag transits from a holding state to NG state at time t4 shown in FIG. 3H.

Time Series Operation of Evaporation Fuel Treatment Apparatus 11 in an Embodiment According to the Invention In the following, the time series operation of an evaporated fuel treatment apparatus 11 in an embodiment according to the invention will be described, referring to FIGS. 4A-4D, 4E-4H, and 4I-4L.

FIGS. 4A-4D and 4E-4H are time chart diagrams for illustration of the operation of an evaporated fuel treatment apparatus 11 (in a normal state without leak) in an embodiment according to the invention after turning the ignition switch from ON to OFF. FIGS. 4I-4L are time chart diagrams for illustration of the operation of an evaporated fuel treatment apparatus 11 (in an abnormal state with leak) in an embodiment according to the invention after turning the ignition switch from ON to OFF.

First, the operation of an evaporated fuel treatment apparatus 11 in an embodiment according to the invention in the normal state without leak will be described, referring to FIGS. 4A-4D. It will be assumed that the season is spring and the ambient temperature is for example approximately 20 degrees centigrade.

Figures 4A, 4B, 4C, 4D:
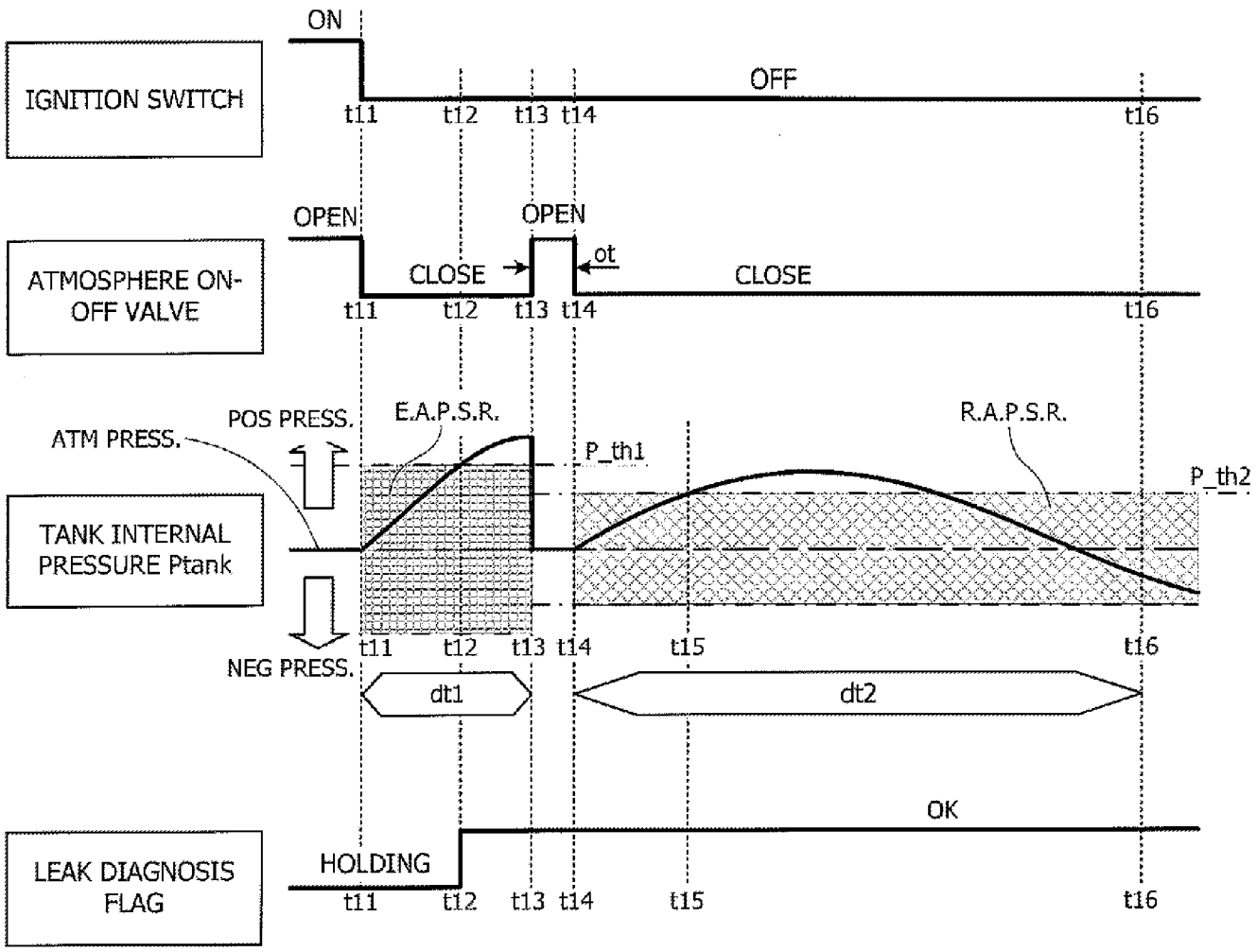
FIG. 4A is a time chart diagram for illustrating the operation of an evaporated fuel treatment apparatus (in a normal state without leak) after switching the ignition switch from ON to OFF, in an embodiment according to the invention.
FIG. 4B is a time chart diagram for illustrating the operation of an evaporated fuel treatment apparatus (in the normal state without leak) after switching the ignition switch from ON to OFF, in an embodiment according to the invention.
FIG. 4C is a time chart diagram for illustrating the operation of an evaporated fuel treatment apparatus (in the normal state without leak) after switching the ignition switch from ON to OFF, in an embodiment according to the invention.
FIG. 4D is a time chart diagram for illustrating the operation of an evaporated fuel treatment apparatus (in the normal state without leak) after switching the ignition switch from ON to OFF, in an embodiment according to the invention.

When the ignition switch 43 is turned from ON to OFF at time t11 shown in FIG. 4A, the timer for leak diagnosis starts counting.

At time t11 shown in FIGS. 4B-4D, the operation of the respective sections other than the ignition switch 43 belonging to an evaporated fuel treatment apparatus 11 in an embodiment according to the invention is as follows. That is, the atmosphere on-off valve 29 is turned from open state to close state (see FIG. 4B). The tank internal pressure Ptank detected by the tank internal pressure sensor 27 indicates the atmospheric pressure (see FIG. 4C). The leak diagnosis flag representing a result of leak diagnosis is in a holding state because it is before the leak diagnosis (see FIG. 4D).

Incidentally, although description has been made above, taking an example of turning the atmosphere on-off valve 29 from open state to close state in synchronization with the timing t11 when the ignition switch 43 is turned from ON to OFF, the invention is not limited to this example. Arrangement may be adopted such that the atmosphere on-off valve 29 is turned from open state to close state after a predetermined time (earlier than time t12 ) delayed from time t11.

With such an arrangement, after the ignition switch 43 is turned from ON to OFF at time t11, the tank internal pressure Ptank can be stabilized before the first diagnosis period dt1 of the first diagnosis stage starts (in this case of example, the first diagnosis period dt1 is started at the time when a predetermined delay time has elapsed from time t11).

During the period from time t11 to t13 shown in FIG. 4A, the ignition switch 43 maintains OFF state. The atmosphere on-off valve 29 maintains the close state (see FIG. 4B). The tank internal pressure Ptank detected by the tank internal pressure sensor 27 tens to deviate at time t12 shown in FIG. 4C from an expanded atmospheric pressure stagnating region to the positive pressure side, and thereafter continue to gradually increase.

Herein, the expanded atmospheric pressure stagnating region (E.A.P.S.R.) is a region partitioned by the first threshold value P_th1 used in the first diagnosis stage (see FIG. 4C) to judge whether the tank internal pressure Ptank detected by the tank internal pressure sensor 27 is stagnating in the vicinity of the atmospheric pressure.

Based on that, as described above, the first diagnosis period dt1 of the first diagnosis stage is set to a shorter time length compared with the second diagnosis period dt2 of the second leak diagnosis described later, the expanded atmospheric pressure stagnating region is expanded by (P_th1-P_th2) compared with the reference atmospheric pressure stagnating region (R.A.P.S.R., see FIG. 4C) partitioned by the second threshold value P_th2 used in the second diagnosis stage. This is based on a requirement for performing leak diagnosis with high accuracy in a short time length.

The period from time t11 to time t13 shown in FIGS. 4A-4D (the period in which the count value of the timer for leak diagnosis is within a stabilizing time period supposed to be required for stabilization compared with the state immediately after the ignition switch 43 is turned off (time t11)) corresponds to the first diagnosis period dt1 of the first diagnosis stage. On the evaporated fuel treatment apparatus 11 in an embodiment according to the invention, the first leak diagnosis using PFD method (pressure fluctuation detection method) is performed in the first diagnosis period dt1 from time t11 to time t13. It is appropriate to perform leak diagnosis of the evaporated fuel tightly-closed system in the first diagnosis period dt1 , because residual heat caused by the internal combustion engine 13 itself and the exhaust system of the internal combustion engine 13 is high immediately after the ignition switch 43 is turned off.

Incidentally, on the evaporated fuel treatment apparatus of the comparative example, leak diagnosis is not performed during the period from time t1 to t2 (the period corresponding to the stabilizing time) shown in FIGS. 3A-3D.

The phenomenon that, during when an evaporated fuel tightly-closed system is formed, the tank internal pressure Ptank detected by the tank internal pressure sensor 27 deviates from the expanded atmospheric pressure stagnating region (see time t12 in FIG. 4C) is a phenomenon which occurs in a case that the evaporated fuel tightly-closed system is in a normal state without leak in the first diagnosis stage. Thus, an evaporated fuel treatment apparatus 11 in an embodiment according to the invention determines at time t12 by leak diagnosis using PFD method that the evaporated fuel tightly-closed system is in a normal state without leak (OK state). Accordingly, the leak diagnosis flag representing a result of leak diagnosis transits from the holding state to OK state, and thereafter maintains OK state until time t16 and after (see FIG. 4D).

At time t13 shown in FIG. 4B, the atmosphere on-off valve 29 is turned from the close state to the open state to reset the history of the tank internal pressure Ptank related to the first leak diagnosis, and thereafter maintains the open state until time t14 . During the same period from t13 to t14 shown in FIG. 4C, the tank internal pressure Ptank detected by the tank internal pressure sensor 27 indicates the atmospheric pressure. The leak diagnosis flag representing a result of leak diagnosis maintains OK state (see FIG. 4D).

Time t14 is a timing when the count value of the timer for leak diagnosis has reached a value corresponding to the stabilizing time period supposed to be required for stabilization compared with the state immediately the ignition switch 43 is turned off (time t11).

When the atmosphere on-off valve 29 is turned from the open state to the close state at time t14 shown in FIG. 4B, during the second diagnosis period dt2 of the second diagnosis stage (see time from t14 to time t16), in addition to leak diagnosis using PFD method (see the temporal characteristic graph of the tank internal pressure Ptank in FIG. 4C), the second leak diagnoses (not shown) using DTM method and DDP method are performed.

Incidentally, the second leak diagnosis performed during the period from time t14 to time t16 on an evaporated fuel treatment apparatus 11, in an embodiment according to the invention, corresponds to the leak diagnosis performed during the period from time t2 to t4 on the evaporated fuel treatment apparatus of the comparative example.

During the period from time t14 to t16 shown in FIG. 4A, the ignition switch 43 continues to maintain OFF state. During the same period from time t to time t16 shown in FIG. 4B, the atmosphere on-off valve 29 maintains the close state. The tank internal pressure Ptank detected by the tank internal pressure sensor 27 tends to deviate at the time t15 shown in FIG. 4C from the reference atmospheric pressure stagnating region partitioned by the second threshold value P_th2 used in the second diagnosis stage, and thereafter again converse into the referential atmospheric pressure stagnating region.

Herein, the phenomenon that, during when an evaporated fuel tightly-closed system is formed, the tank internal pressure Ptank detected by the tank internal pressure sensor 27 deviates from the reference atmospheric pressure stagnating region (see time t15 in FIG. 4C) is a phenomenon which occurs in a case that the evaporated fuel tightly-closed system is in a normal state without leak during the second diagnosis stage. Thus, an evaporated fuel treatment apparatus 11 in an embodiment according to the invention determines at time t15 by leak diagnosis using PFD method that the evaporated fuel tightly-closed system is in a normal state without leak (OK state). In the case shown in FIGS. 4A-4D, the leak diagnosis flag was already transited at time t12 from the holding state to OK state. In this case, an evaporated fuel treatment apparatus 11 in an embodiment according to the invention makes the leak diagnosis flag maintain OK state as it is (see FIG. 4D).

Incidentally, an evaporated fuel treatment apparatus 11 in an embodiment according to the invention performs an integrated leak diagnosis according to the procedure based on FIG. 2B. Concretely, in this integrated leak diagnosis, starting at time t14 in the second diagnosis stage, in addition to a leak diagnosis using PFD method, leak diagnoses using DTM method and DDP method are respectively performed. When results of the leak diagnoses by PFD method, DTM method, and DDP method are obtained, the result of leak diagnosis by DTM method is in principle adopted being given priority as a result of integrated leak diagnosis, and on the other hand, the result of the leak diagnosis by DDP method is secondarily adopted as a result of an integrated leak diagnosis in a case that the result of the leak diagnosis by DTM method is held (including impossibility of diagnosis.)

However, in a case that the result of the leak diagnosis using PFD method is normal (OK state), as shown in FIG. 4D, the result of the leak diagnosis by PFD method may be used being given priority over the results of the leak diagnoses by DDM method and DDP method.

In the following, the operation of an evaporated fuel treatment apparatus 11 in an embodiment according to the invention in a normal state without leak will be described, referring FIGS. 4E-4H. Partial operation is common to the case shown in FIGS. 4A-4D in a normal state without leak and the case shown in FIGS. 4E-4H in a normal state without leak. Therefore, on the case of FIGS. 4E-4H, description overlapping with the case of FIGS. 4A-4D will be omitted, and description will be made, focusing on the difference between the two cases.

The difference between the two cases is that while determination is made in the case of FIGS. 4A-4D by diagnosis that both the first diagnosis stage and the second diagnosis stage are free from leak, determination is made in the case of FIGS. 4E-4H by diagnosis that only the second diagnosis stage is free from leak (Determination is not made through the first leak diagnosis such that there is no leak.)

Figures 4E, 4F, 4G, 4H:
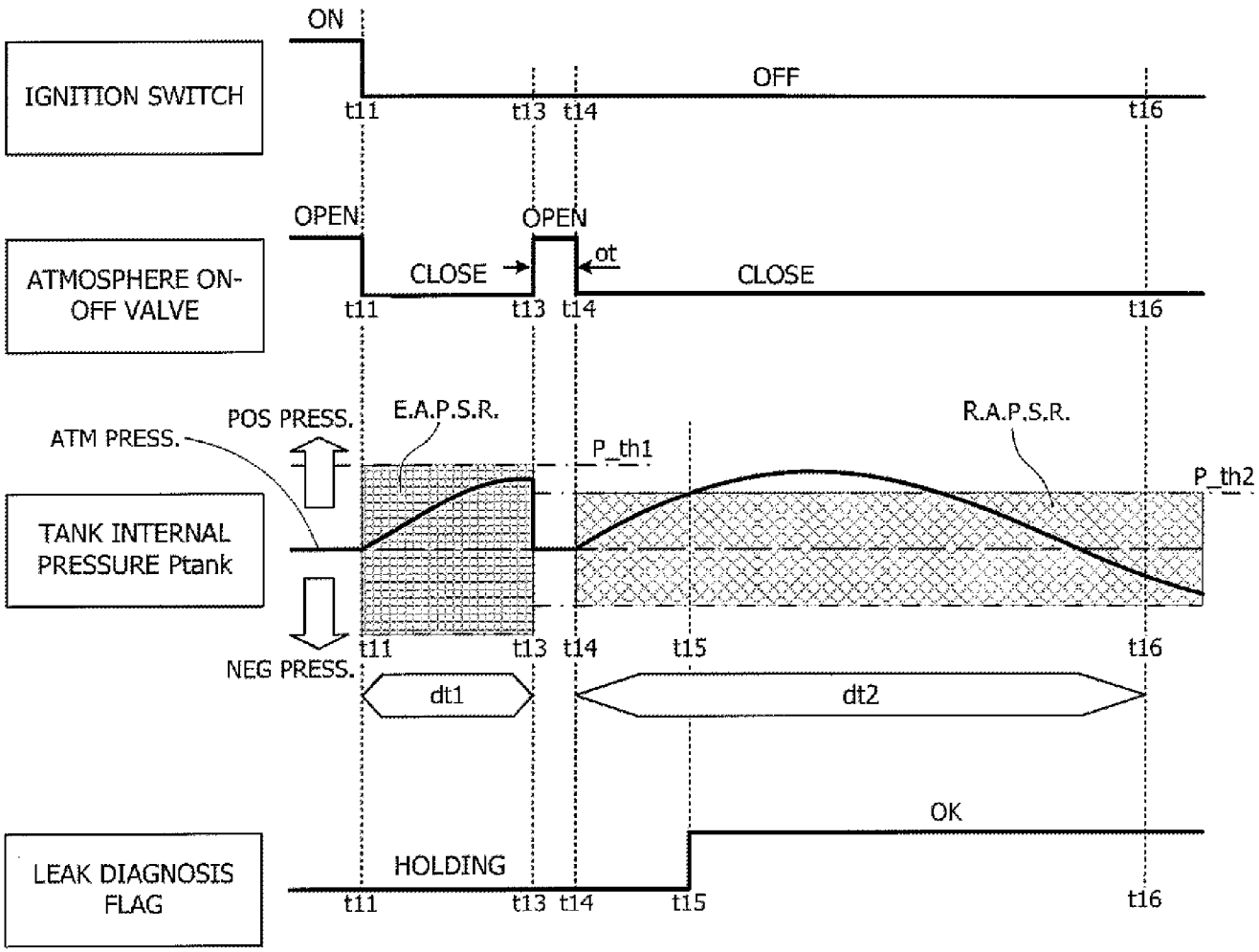
FIG. 4E is a time chart diagram for illustrating the operation of an evaporated fuel treatment apparatus (in the normal state without leak) after switching the ignition switch from ON to OFF, in an embodiment according to the invention.
FIG. 4F is a time chart diagram for illustrating the operation of an evaporated fuel treatment apparatus (in the normal state without leak) after switching the ignition switch from ON to OFF, in an embodiment according to the invention.
FIG. 4G is a time chart diagram for illustrating the operation of an evaporated fuel treatment apparatus (in the normal state without leak) after switching the ignition switch from ON to OFF, in an embodiment according to the invention.
FIG. 4H is a time chart diagram for illustrating the operation of an evaporated fuel treatment apparatus (in the normal state without leak) after switching the ignition switch from ON to OFF, in an embodiment according to the invention.

Concretely, in the case of FIGS. 4E-4H, an evaporated fuel treatment apparatus 11 in an embodiment according to the invention determines at time t15 shown in FIG. 4H that the evaporated fuel tightly-closed system is in a normal state (OK state) without leak by a leak diagnosis using PFD method. Then, at the same time t15, the leak diagnosis flag representing a result of the leak diagnosis transits from a holding state to OK state, and then maintains OK state until time t16 and after (see FIG. 4H).

An evaporated fuel treatment apparatus 11 in an embodiment according to the invention performs an integrated leak diagnosis according to the procedure based on FIG. 2B, similarly to the case of FIGS. 4A-4D. Concretely, in this integrated leak diagnosis, starting at time t14 of the second diagnosis stage, in addition to a leak diagnosis using PFD method, leak diagnoses using DTM method and DDP method are respectively performed. When results of the leak diagnoses by PFD method, DTM method, and DDP method are obtained, while the result of leak diagnosis by DTM method is in principle adopted being given priority as a result of integrated leak diagnosis, the result of the leak diagnosis by DDP method is secondarily adopted as a result of an integrated leak diagnosis in a case that the result of the leak diagnosis by DTM method is held (including impossibility of diagnosis.)

In the following, the operation of an evaporated fuel treatment apparatus 11 in an embodiment according to the invention in an abnormal state with leak will be described, referring FIGS. 4I-4L. Partial operation is common to the case shown in FIGS. 4A-4D in a normal state without leak and the case shown in FIGS. 4I-4L in an abnormal state with leak. Therefore, on the case of FIGS. 4I-4L, description overlapping with the case of FIGS. 4A-4D will be omitted, and description will be made, focusing on the difference between the two cases.

The difference between the two cases is that while determination is made through diagnosis in the case of FIGS. 4A-4D that both the first diagnosis stage and the second diagnosis stage are free from leak, determination is made through diagnosis in the case of FIGS. 4I-4L that leak occurs at least in the second diagnosis stage.

Figures 4I, 4J, 4K, 4L:
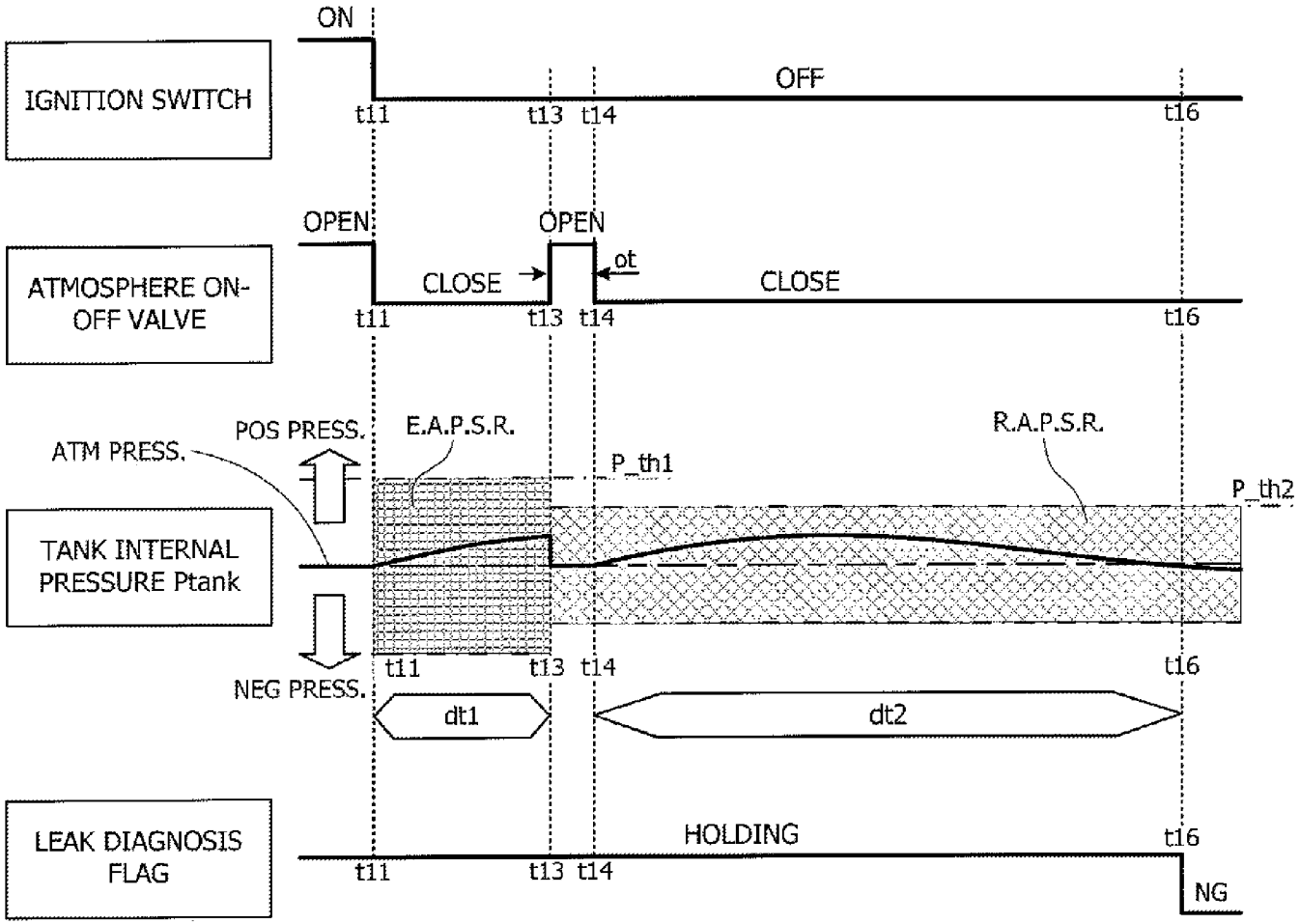
FIG. 4I is a time chart diagram for illustrating the operation of an evaporated fuel treatment apparatus (in an abnormal state with leak) after switching the ignition switch from ON to OFF, in an embodiment according to the invention.
FIG. 4J is a time chart diagram for illustrating the operation of an evaporated fuel treatment apparatus (in the abnormal state with leak) after switching the ignition switch from ON to OFF, in an embodiment according to the invention.
FIG. 4K is a time chart diagram for illustrating the operation of an evaporated fuel treatment apparatus (in the abnormal state with leak) after switching the ignition switch from ON to OFF, in an embodiment according to the invention.
FIG. 4L is a time chart diagram for illustrating the operation of an evaporated fuel treatment apparatus (in an abnormal state with leak) after switching the ignition switch from ON to OFF, in an embodiment according to the invention.

Concretely, in the case of FIGS. 4I-4L, an evaporated fuel treatment apparatus 11 in an embodiment according to the invention determines at time t16 shown in FIG. 4L that the evaporated fuel tightly-closed system has leak (NG state) if a diagnosis result that the second diagnosis stage is free from leak is not obtained. Then, at the same time t16, the leak diagnosis flag representing a result of the leak diagnosis transits from a holding state to NG state, and thereafter maintains NG state (see FIG. 4L).

An evaporated fuel treatment apparatus 11 in an embodiment according to the invention performs an integrated leak diagnosis according to the procedure based on FIG. 2B, similarly to the case of FIGS. 4A-4D. Concretely, in this integrated leak diagnosis, starting at time t14 of the second diagnosis stage, in addition to a leak diagnosis using PFD method, leak diagnoses using DTM method and DDP method are respectively performed. When results of the leak diagnoses by PFD method, DTM method, and DDP method are obtained, while the result of leak diagnosis by DTM method is in principle adopted being given priority as a result of integrated leak diagnosis, the result of the leak diagnosis by DDP method is secondarily adopted as a result of an integrated leak diagnosis in a case that the result of the leak diagnosis by DTM method is held (including impossibility of diagnosis.)

The case of FIGS. 4I-4L assumes that an evaporated fuel treatment apparatus 11 (the diagnosis section 53) in an embodiment according to the invention has determined, by leak diagnosis related to DTM method, that the evaporated fuel tightly-closed system has leak (NG state). As a result, according to the principle of adopting a result of leak diagnosis by DTM method, giving priority, as a result of integrated leak diagnosis, the evaporated fuel treatment apparatus 11 (the diagnosis section 53) determines that the evaporated fuel tightly-closed system has leak and is in an abnormal state (NG state).

Operation and Advantages of an Evaporation Fuel Treatment Apparatus 11 in an Embodiment According to the Invention The operation and the advantages of an evaporated fuel treatment apparatus 11 in an embodiment according to the invention will be described below.

An evaporated fuel treatment apparatus 11 based on the first point of view in the present embodiment according to the invention includes the fuel tank 15, which is mounted on the vehicle having the internal combustion engine 13 to reserve fuel, the canister 17, which is provided between the communication passages (the evaporated fuel exhaust passage 25 and the atmospheric air flow passage 26) connecting the fuel tank 15 and the atmosphere to collect evaporated fuel exhausted from the fuel tank 15 through the communication passages 25 and 26, the atmosphere on-off valve 29, which is provided at the communication passage 26 connecting the canister 17 and the atmosphere to open/close the canister 17 to/and from the atmosphere, the tank internal pressure sensor (tank internal pressure detection section) 27 for detecting the tank internal pressure Ptank of the fuel tank 15, the control section 55 for instructing the atmosphere on-off valve 29 to open and close, and the diagnosis section 53 for performing leak diagnosis of the evaporated fuel tightly-closed system including the fuel tank 15.

In the evaporated fuel treatment apparatus 11 based on the first point of view, after the ignition switch 43 of the vehicle is turned off, in the first diagnosis stage in which the atmosphere on-off valve 29 is in a close state, according to a closing instruction from the control section 55, the diagnosis section 53 performs the first leak diagnosis using PFD method (pressure fluctuation detection method), based on the relationship between the tank internal pressure Ptank detected by the tank internal pressure sensor (the tank internal pressure detection section) 27 and the predetermined first threshold value P_th1; and after the first leak diagnosis is completed, in the second leak diagnosis stage in which the atmosphere on-off valve 29 is in the close state, according to a closing instruction from the control section 55, the diagnosis section 53 performs the second leak diagnosis using PFD method (pressure fluctuation detection method), based on the relationship between a tank internal pressure Ptank detected by the tank internal pressure sensor (the tank internal pressure detection section) 27 and the predetermined second threshold value P_th2. Herein, after completion of the first leak diagnosis, the atmosphere on-off valve 29 is once opened, according to an opening instruction from the control section 55. The first threshold value P_th1 used in the first diagnosis stage is set with a larger deviation from the atmospheric pressure compared with the second threshold value P_th2 used in the second diagnosis stage.

In the evaporated fuel treatment apparatus 11 based on the first point of view, in performing leak diagnosis using PFD method (pressure fluctuation detection method) in divided two stages after the ignition switch 43 of the vehicle is turned off, the residual heat of the internal combustion engine 13 and the exhaustion system of the internal combustion engine 13 after the turning off of the ignition switch 43 has more significant effect in the first diagnosis stage than in the second diagnosis stage, and accordingly the first threshold value P_th1 used in the first diagnosis stage is set with a larger deviation from the atmospheric pressure compared with the second threshold value P_th2 used in the second diagnosis stage.

By the evaporated fuel treatment apparatus 11 based on the first point of view, the first and second threshold values P_th1 and P_th2 are appropriately set, taking into account the widths of fluctuation of the respective tank internal pressures Ptank detected by the tank internal pressure sensor (the tank internal pressure detection section) 27 in the first and second diagnosis stages. Consequently, for example, even in a case of applying the invention to a hybrid vehicle, leak diagnosis of the evaporated fuel tightly-closed system can be carried out with high accuracy.

An evaporated fuel treatment apparatus 11 based on the second point of view in an embodiment according to the invention is the evaporated fuel treatment apparatus 11 based on the first point of view, wherein arrangement may be adopted such that the first diagnosis period of the first diagnosis stage is a stabilizing time period supposed to be required for stabilization of the tank internal pressure Ptank, the stabilization being made compared with the tank internal pressure Ptank that is immediately after the ignition switch 43 is turned off, and the first diagnosis period of the first diagnosis stage may be set to a shorter time length compared with the second diagnosis period of the second diagnosis stage.

In the evaporated fuel treatment apparatus 11 based on the second point of view, in performing leak diagnosis in divided two stages after the ignition switch 43 of the vehicle is turned off, the residual heat of the internal combustion engine 13 and the exhaustion system of the internal combustion engine 13 after the turning off of the ignition switch 43 has more significant effect in the first diagnosis stage than in the second diagnosis stage, and accordingly the first diagnosis period dt1 of the first diagnosis stage is set to a shorter time length than the second diagnosis period dt2 of the second diagnosis stage.

By the evaporated fuel treatment apparatus 11 based on the second point of view, the lengths of the first diagnosis period dt1 and the second diagnosis period dt2 are set to appropriate lengths, taking into account the temporal variation rates of the respective tank internal pressures Ptank detected by the tank internal pressure sensor (tank internal pressure detection section) 27 in the respective diagnosis stages, namely the first and second diagnosis stages. Consequently, compared with the evaporated fuel treatment apparatus 11 based on the first point of view, the accuracy of leak diagnosis of the evaporated fuel tightly-closed system can be further improved.

Further, an evaporated fuel treatment apparatus 11 based on the third (fourth) point of view in an embodiment according to the invention is the evaporated fuel treatment apparatus 11 based on the first point of view, wherein arrangement may be adopted such that the atmosphere on-off valve 29 is once opened immediately after completion of the first leak diagnosis, according to an opening instruction from the control section 55, and the diagnosis section 53 starts the second diagnosis immediately after the atmosphere on-off valve 29 is switched from the open state to a close state, according to a closing instruction from the control section 55.

By the evaporated fuel treatment apparatus 11 based on the third (fourth) point of view, the atmosphere on-off valve 29 is once opened immediately after completion of the first leak diagnosis, according to an opening instruction from the control section 55, and the diagnosis section 53 starts the second diagnosis, omitting a wasteful time, immediately after the atmosphere on-off valve 29 is switched from the open state to a close state, according to a closing instruction from the control section 55. Consequently, it is possible to carry out leak diagnosis of the evaporated fuel tightly-closed system in a shorter time and with a further higher accuracy, compared with the evaporated fuel treatment apparatus 11 based on the first (second) point of view.

On the other hand, the evaporated fuel treatment apparatus 11 based on the fifth point of view may be arranged such that, after the ignition switch 43 of the vehicle is turned off, in a state that the atmosphere on-off valve 29 is closed, according to a closing instruction from the control section 55, the diagnosis section 53 performs a leak diagnosis of the evaporated fuel tightly-closed system using the double differentiation method based on a correlation parameter related to the secondary differentiation value of the tank internal pressure Ptank detected by the tank internal pressure sensor 27; performs a leak diagnosis of the evaporated fuel tightly-closed system using the stagnation time method based on the relationship between the tank internal pressure Ptank detected by the tank internal pressure sensor (the tank internal pressure detection section) 27 and the stagnation time of the tank internal pressure Ptank; and uses a result of the leak diagnosis using the stagnation time method (DTM method), giving priority over a result of the leak diagnosis using the double differentiation method (DDP method).

The evaporated fuel treatment apparatus 11 based on the fifth point of view uses a result of a leak diagnosis using the stagnation time method (DTM method) with a higher accuracy compared with the double differentiation method (DDP method), giving priority over a result of a leak diagnosis using the double differentiation method (DDP method). For example, in a case that the result of the leak diagnosis using the stagnation time method (DTM method) is a normal state without leak, the diagnosis section 53 determines a normal state without leak, regardless of the result of the leak diagnosis using the double differentiation method (DDP method).

In this way, as the evaporated fuel treatment apparatus 11 uses a result of a leak diagnosis using the stagnation time method (DTM method) with a higher accuracy compared with the double differentiation method (DDP method), giving priority over a result of a leak diagnosis using the double differentiation method (DDP method), it is possible by the evaporated fuel treatment apparatus 11 based on the fifth point of view to carry out leak diagnosis of the evaporated fuel tightly-closed system with high accuracy even in a case of applying the invention to a hybrid vehicle.

Further, the evaporated fuel treatment apparatus 11 based on the sixth point of view is the evaporated fuel treatment apparatus 11 based on the fifth point of view, and arrangement may be adopted such that the diagnosis time for obtaining a result of a leak diagnosis using the stagnation time method (DTM method) is set to a time length longer than the diagnosis time for obtaining a result of a leak diagnosis using the double differentiation method (DDP method).

By the evaporated fuel treatment apparatus 11 based on the sixth point of view, as it is possible to appropriately perform a leak diagnosis using the stagnation time method (DTM method), which requires a longer diagnosis time compared with the double differentiation method (DDP method), it is possible to carry out a leak diagnosis of the evaporated fuel tightly-closed system with a further higher accuracy.

Still further, the evaporated fuel treatment apparatus 11 based on the seventh (eighth) point of view is the evaporated fuel treatment apparatus 11 based on the fifth (sixth) point of view, wherein in the first diagnosis stage in which the atmosphere on-off valve 29 is in a close state according to a closing instruction from the control section 55 after the turning off of the ignition switch 43 of the vehicle, the diagnosis section 53 performs the first leak diagnosis using PFD method (pressure fluctuation detection method) based on the relationship between a tank internal pressure Ptank by the tank internal pressure sensor (tank internal pressure detection section) 27 and the predetermined first threshold value P_th1; and after completion of the first leak diagnosis, in the second diagnosis stage in which the atmosphere on-off valve 29 is in a close state according to a closing instruction from the control section 55, the diagnosis section 53 performs the second leak diagnosis, using the pressure fluctuation detection method (PFD method) based on the relationship between the tank internal pressure Ptank by the tank internal pressure sensor (tank internal pressure detection section) 27 and the predetermined second threshold value P_th2, using the above-described double differentiation method (DDP method), and using the above-described stagnation time method (DTM method).

After the first leak diagnosis is completed, the atmosphere on-off valve 29 is once opened according to an opening instruction from the control section 55. If a result of the second leak diagnosis using the pressure fluctuation detection method (PFD method) is an abnormal state with leak, the diagnosis section 53 determines an abnormal state with leak, regardless of a result of the second leak diagnosis using the double differentiation method (DDP method) or the stagnation time method (DTM method).

Herein, the pressure fluctuation detection method (PFD method) is suitably used in detecting a leak hole with a comparatively large diameter, while the double differentiation method (DDP method) is suitably used in detecting a leak hole with a comparatively small diameter. Accordingly, even in a case that a result of the second leak diagnosis using the pressure fluctuation detection method (PFD method) is a normal state without leak, it is still possible that there is a leak hole with a comparatively small diameter.

In this situation, even in a case that a result of the second leak diagnosis using the pressure fluctuation detection method (PFD method) is a normal state without leak, leak diagnosis using the double differentiation method (DDP method) or the stagnation time method (DTM method) is definitely performed. On the other hand, in case that a result of the second leak diagnosis using the pressure fluctuation detection method (PFD method) is an abnormal state with leak, it is not always necessary to perform the second leak diagnosis using the double differentiation method (DDP method) or the stagnation time method (DTM method).

In the evaporated fuel treatment apparatus 11 based on the seventh (eighth) point of view, in a case that a result of the second leak diagnosis using the pressure fluctuation detection method (PFD method) is an abnormal state with leak, the diagnosis section 53 determines an abnormal state with leak, regardless of a result of the second leak diagnosis using the double differentiation method (DDP method) or the stagnation time method (DTM method). Consequently, a leak diagnosis of the evaporated fuel tightly-closed system can be performed in a shorter time compared with the evaporated fuel treatment apparatus 11 based on the fifth (sixth) view point.

Other Embodiments

In the foregoing plural embodiments, examples of embodying the invention have been described. Accordingly, the technical scope of the invention should not be understood, being limited by these embodiments. This is because the invention can be carried out in various embodiments, without departing from the spirit and the primary features thereof.

For example, the forgoing embodiments of the invention have been described, taking examples where the temperature in an evaporated fuel tightly-closed system after an ignition switch 43 is turned off transits to the higher temperature side, however, the invention is not limited to these examples. The invention can also be applied to a case that the temperature in an evaporated fuel tightly-closed system after an ignition switch 43 is turned off transits to the lower temperature side (for example, a case with a temperature of zero degree centigrade or lower). In a case that the temperature in an evaporated fuel tightly-closed system after an ignition switch 43 is turned off transits to the lower temperature side, the tank internal pressure in a tightly closed state becomes a negative pressure through liquefaction (condensation) of evaporated fuel reserved in a fuel tank 15. In such a case, the invention can be carried out similarly to an embodiment in which the tank internal pressure in a tightly closed state becomes a positive pressure, by making appropriate modification.

Further, the foregoing embodiments according to the invention have been described, taking an example where an evaporated fuel treatment apparatus 11 in an embodiment according to the invention is applied to a hybrid vehicle provided with an internal combustion engine 13 and an electric motor as drive sources, however, the invention is not limited thereto. It is needless to say that the invention may be applied to a vehicle provided with only an internal combustion engine 13 as a drive source.

What is claimed is:

1. An evaporated fuel treatment apparatus, comprising:

a fuel tank configured to reserve fuel, the tank being mounted on a vehicle having an internal combustion engine;

a canister provided between communication passages connecting the fuel tank and atmosphere to collect evaporated fuel exhausted from the fuel tank through the communication passage;

an on-off valve provided at the communication passage connecting the canister and the atmosphere to open the canister to the atmosphere or close the canister from the atmosphere;

a tank internal pressure detection section configured to detect a tank internal pressure of the fuel tank;

a control section configured to issue an instruction to open or close the on-off valve; and a diagnosis section configured to perform leak diagnosis of an evaporated fuel tightly-closed system including the fuel tank, wherein, after an ignition switch of the vehicle is turned off, in a first diagnosis stage in which the on-off valve is in a close state, according to the instruction from the control section, the diagnosis section performs a first leak diagnosis, based on a relationship between the tank internal pressure detected by the tank internal pressure detection section and a predetermined first threshold value; and after the first leak diagnosis is completed, in a second leak diagnosis stage in which the on-off valve is in the close state, according to the instruction from the control section, the diagnosis section performs a second leak diagnosis, based on a relationship between the tank internal pressure detected by the tank internal pressure detection section and a predetermined second threshold value, wherein the on-off valve is once opened, according to the instruction from the control section, after the first leak diagnosis is completed, and wherein the first threshold value used in the first diagnosis stage is set with a larger deviation from an atmospheric pressure compared with the second threshold value used in the second diagnosis stage.

2. The evaporated fuel treatment apparatus according to claim 1, wherein a first diagnosis period of the first diagnosis stage is within a stabilizing time period that is supposed to be required for stabilization of the tank internal pressure in comparison with a state immediately after the ignition switch is turned off, and the first diagnosis period is set to a time length shorter than a second diagnosis period of the second diagnosis stage.

3. The evaporated fuel treatment apparatus according to claim 2, wherein the on-off valve is once opened, according to the instruction from the control section, within a stabilizing time period that is supposed to be required for stabilization of the tank internal pressure in comparison with a state immediately after the ignition switch is turned off, and wherein the diagnosis section starts the second diagnosis immediately after the on-off valve is turned from an open state to the close state, according to the instruction from the control section.

4. The evaporated fuel treatment apparatus according to claim 1, wherein the on-off valve is once opened, according to the instruction from the control section, within a stabilizing time period that is supposed to be required for stabilization of the tank internal pressure in comparison with a state immediately after the ignition switch is turned off, and wherein the diagnosis section starts the second diagnosis immediately after the on-off valve is turned from an open state to the close state, according to the instruction from the control section.

5. An evaporated fuel treatment apparatus, comprising:

a fuel tank for reserving fuel, the tank being mounted on a vehicle having an internal combustion engine;

a canister provided between communication passages connecting the fuel tank and atmosphere to collect evaporated fuel exhausted from the fuel tank through the communication passage;

an on-off valve provided at the communication passage connecting the canister and the atmosphere to open or close the canister to/from the atmosphere;

a tank internal pressure detection section for detecting a tank internal pressure of the fuel tank;

a control section for issuing an instruction to open or close the on-off valve; and a diagnosis section for performing leak diagnosis of an evaporated fuel tightly-closed system including the fuel tank, wherein, in a state that the on-off valve is closed according to the instruction from the control section after an ignition switch of the vehicle is turned off, the diagnosis section:

performs a leak diagnosis of the evaporated fuel tightly-closed system, using a double differentiation method based on a correlation parameter related to a secondary differentiation value of the tank internal pressure detected by the tank internal pressure detection section;

performs a leak diagnosis of the evaporated fuel tightly-closed system, using a stagnation time method based on a relationship between a tank internal pressure detected by the tank internal pressure detection section and a stagnation time of the tank internal pressure; and uses a result of the leak diagnosis using the stagnation time method, giving priority over a result of the leak diagnosis using the double differentiation method;

wherein, in a first diagnosis stage in which the on-off valve is in a close state according to the instruction from the control section after the ignition switch of the vehicle is turned off, the diagnosis section performs a first leak diagnosis; and wherein after the first leak diagnosis is completed, the on-off valve is once opened according to the instruction from the control section.

6. The evaporated fuel treatment apparatus according to claim 5, wherein a diagnosis time for obtaining a result of a leak diagnosis using the stagnation time method is set to a time length longer than a diagnosis time for obtaining a result of a leak diagnosis using the double differentiation method.

7. The evaporated fuel treatment apparatus according to claim 6, wherein, in the first diagnosis stage, the diagnosis section performs the first leak diagnosis based on a relationship between the tank internal pressure detected by the tank internal pressure detection section and a predetermined first threshold value; and in a second diagnosis stage in which the on-off valve is in the close state according to the instruction from the control section after completion of the first leak diagnosis, the diagnosis section performs a second leak diagnosis, using a pressure fluctuation detection method based on a relationship between the tank internal pressure detected by the tank internal pressure detection section and a predetermined second threshold value, the double differentiation method, and the stagnation time method, and wherein, if a result of the second leak diagnosis using the pressure fluctuation detection method is an abnormal state with leak, the diagnosis section determines an abnormal state with leak, regardless of a result of the second leak diagnosis using the double differentiation method or the stagnation time method.

8. The evaporated fuel treatment apparatus according to claim 5, wherein, in the first diagnosis stage, the diagnosis section performs the first leak diagnosis based on a relationship between the tank internal pressure detected by the tank internal pressure detection section and a predetermined first threshold value; and in a second diagnosis stage in which the on-off valve is in the close state according to the instruction from the control section after completion of the first leak diagnosis, the diagnosis section performs a second leak diagnosis, using a pressure fluctuation detection method based on a relationship between the tank internal pressure detected by the tank internal pressure detection section and a predetermined second threshold value, the double differentiation method, and the stagnation time method, and wherein, if a result of the second leak diagnosis using the pressure fluctuation detection method is an abnormal state with leak, the diagnosis section determines an abnormal state with leak, regardless of a result of the second leak diagnosis using the double differentiation method or the stagnation time method.

* * * * *